US010640979B2

(12) United States Patent
Grubka et al.

(10) Patent No.: US 10,640,979 B2
(45) Date of Patent: May 5, 2020

(54) PREFABRICATED OFFSET SHINGLE

(71) Applicant: Owens Corning Intellectual Capital, LLC, Toledo, OH (US)

(72) Inventors: Lawrence Jerome Grubka, New Albany, OH (US); John Childers, Westland, MI (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 16/198,077

(22) Filed: Nov. 21, 2018

(65) Prior Publication Data

US 2019/0093363 A1 Mar. 28, 2019

Related U.S. Application Data

(63) Continuation-in-part of application No. 15/790,136, filed on Oct. 23, 2017, now Pat. No. 10,487,508.

(60) Provisional application No. 62/433,684, filed on Dec. 13, 2016, provisional application No. 62/411,122, filed on Oct. 21, 2016.

(51) Int. Cl.

| | |
|---|---|
| ***B65D 85/62*** | (2006.01) |
| ***E04D 1/26*** | (2006.01) |
| ***E04D 1/36*** | (2006.01) |
| ***B65D 65/22*** | (2006.01) |
| ***B65D 71/12*** | (2006.01) |
| ***B65D 65/10*** | (2006.01) |
| ***E04D 13/00*** | (2006.01) |
| ***B65B 53/02*** | (2006.01) |

(52) U.S. Cl.

CPC ..... *E04D 1/26* (2013.01); *B65B 53/02* (2013.01); *B65D 65/10* (2013.01); *B65D 65/22* (2013.01); *B65D 71/125* (2013.01); *B65D 85/62* (2013.01); *E04D 1/36* (2013.01); *E04D 13/00* (2013.01)

(58) Field of Classification Search

CPC ..... B65D 65/10; B65D 65/22; B65D 71/12; B65D 71/125; B65D 85/62; E04D 1/26; E04D 1/36; E04D 13/00; B65B 53/02

USPC ..... 206/321, 323, 324; 229/87.01, 87.02

See application file for complete search history.

(56) References Cited

U.S. PATENT DOCUMENTS

| | | | | |
|---|---|---|---|---|
| 1,495,070 A | | 5/1924 | Finley | |
| 2,756,699 A | | 7/1956 | Lockwood | |
| 2,885,073 A | * | 5/1959 | Bettoli | B65D 65/403 206/324 |
| 2,952,107 A | * | 9/1960 | Fuller | B65B 11/004 53/209 |

(Continued)

OTHER PUBLICATIONS

Office Action from U.S. Appl. No. 15/790,136 dated Apr. 10, 2019.

(Continued)

*Primary Examiner* — Bryon P Gehman

(74) *Attorney, Agent, or Firm* — Calfee, Halter & Griswold LLP

(57) ABSTRACT

A prefabricated offset shingle kit includes a first shingle packet, a second shingle packet, and a third shingle packet. The first shingle packet has a first wrap portion disposed around only a top face, a bottom face, a front face, a rear face, and a left face. The second shingle packet has a second wrap portion disposed around only a top face, a bottom face, a front face, a rear face, and a right face. The third shingle packet has a wrap portion disposed around only a top face, a bottom face, a front face, and a rear face.

20 Claims, 31 Drawing Sheets

(56) References Cited

U.S. PATENT DOCUMENTS

| | | | | |
|---|---|---|---|---|
| 3,138,251 | A * | 6/1964 | Olszyk | E04D 1/26 206/324 |
| 3,312,031 | A | 4/1967 | Berg | |
| 4,279,106 | A | 7/1981 | Gleason et al. | |
| 4,468,903 | A | 9/1984 | Eaton et al. | |
| 4,527,374 | A | 7/1985 | Corbin | |
| 4,637,191 | A | 1/1987 | Smith | |
| 5,455,099 | A | 10/1995 | Banner | |
| 5,611,186 | A | 3/1997 | Weaver | |
| 5,615,523 | A | 4/1997 | Wells et al. | |
| 6,014,847 | A | 1/2000 | Phillips | |
| 6,021,611 | A | 2/2000 | Wells et al. | |
| 6,083,594 | A | 7/2000 | Weinstein et al. | |
| 6,112,492 | A | 9/2000 | Wells et al. | |
| 6,199,338 | B1 | 3/2001 | Hudson et al. | |
| 6,383,594 | B2 | 5/2002 | Weinstein et al. | |
| 6,484,463 | B1 | 11/2002 | Fay | |
| 6,743,326 | B2 | 6/2004 | Bogrett et al. | |
| 6,935,080 | B2 | 8/2005 | Allwein et al. | |
| 8,430,983 | B2 | 4/2013 | Vermilion et al. | |
| 8,647,184 | B2 | 2/2014 | Kortuem et al. | |
| 8,763,807 | B2 * | 7/2014 | Booch | G01N 21/8901 229/87.01 |
| 9,017,791 | B2 | 4/2015 | Grubka et al. | |
| 9,121,178 | B2 | 9/2015 | Belt et al. | |
| 9,540,817 | B2 | 1/2017 | Folkersen et al. | |
| 10,041,253 | B2 | 8/2018 | Folkersen et al. | |
| 2004/0055227 | A1 | 3/2004 | Allwein et al. | |
| 2004/0111996 | A1 | 6/2004 | Heroneme | |
| 2005/0235582 | A1 | 10/2005 | Allwein et al. | |
| 2008/0280554 | A1 | 11/2008 | Kortuem et al. | |
| 2015/0089892 | A1 | 4/2015 | Jenkins | |
| 2017/0081854 | A1 | 3/2017 | Folkersen et al. | |
| 2017/0306627 | A1 | 10/2017 | Grubka et al. | |

OTHER PUBLICATIONS

Notice of Allowance from U.S. Appl. No. 15/790,136 dated Jul. 22, 2019.

Owens Coming brochure, Classic Super, Shingles Installation Instructions, 8 pgs., Aug. 2015.

Owens Coming brochure, Oakridge Shingles, Installation Instructions, 7 pgs., Aug. 2017.

ASHI Reporter, Oct. 2010, Article by Tom Feiza, "Don't Miss the Shingle Stagger," Inspection News and View from the American Society of Home Inspectors, 8 pgs.

Office Action from U.S. Appl. No. 15/790,136 dated Sep. 18, 2018.

* cited by examiner

PREFABRICATED OFFSET SHINGLE

CROSS-REFERENCE TO RELATED APPLICATIONS

The present application is a continuation-in-part of U.S. application Ser. No. 15/790,136, filed Oct. 23, 2017, which claims the benefit of U.S. Provisional Application Ser. No. 62/411,122, filed on Oct. 21, 2016, titled PREFABRICATED OFFSET SHINGLE and U.S. Provisional Application Ser. No. 62/433,684, filed on Dec. 13, 2016, titled PREFABRICATED OFFSET SHINGLE, the disclosures of which are incorporated herein by reference in their entirety.

TECHNICAL FIELD

The present invention relates generally to roof shingles for protecting a roof of a structure, and more particularly, prefabricated offset shingles and shingle packages for application at the start of courses of shingles.

BACKGROUND OF THE INVENTION

Many structures have pitched, shingled roofs, which prevent water, e.g., rain water, from entering the structures by causing water to pass over the shingles and shed off the roofs. A pitched, shingled roof has a pitched substrate, such as a plurality of plywood sheets, with a plurality of shingles attached thereto.

Each shingle has an upper portion (i.e., a headlap portion) and a lower portion (i.e., an exposure portion) wherein the exposure portion is exposed to the environment. The shingles are typically attached to the substrate in rows known as courses wherein the exposure portion of an upper course of shingles overlaps the headlap portion of an adjacent lower course of shingles. For example, a first course of shingles may be attached to the substrate nearest the lowest point of the roof, i.e., the eave portion of the roof. A second course of shingles may then be attached to the substrate slightly higher on the roof than the first course. The shingles are placed so that the exposure portion of the second course of shingles overlaps the headlap portion of the first course of shingles. This overlapping continues with successive rows of shingles to the highest point on the area of the roof, i.e., the hip or the ridge.

To prevent alignment of the seams between shingles in adjacent courses (and thereby allow for a leak path through the shingles), the first shingle in each course may be cut shorter to create an offset shingle. Offset shingles are applied at the start of a course of shingles, and the width of the offset shingles in each course is varied so the seams between shingles in adjacent courses are not aligned.

Attaching the shingles to the roof is typically achieved by the use of nails or other fastening devices that pass through the shingles and into or through the substrate. The fastening devices are typically placed through the headlap portion of the shingles so that they are overlapped by shingles in an adjacent higher course as described above. This placement of the fasteners prevents water from entering the structure through holes caused by the fasteners.

Some roofs have a membrane (i.e., an underlayment) located between the substrate and the shingles. The membrane may, as an example, be conventional tar paper or other underlayment material that is nailed to the substrate. Strips of the membrane are typically attached to the roof in an overlapping fashion wherein an upper strip overlaps its adjacent lower strip. Accordingly, the membrane serves to shield the substrate from water should a shingle become damaged. For example, if a shingle becomes cracked or otherwise leaks, water will contact the membrane rather than the substrate. Water will then pass along the membrane without contacting the substrate or entering the structure.

SUMMARY

An exemplary prefabricated offset shingle kit includes a first shingle packet, a second shingle packet, and a third shingle packet. The first shingle packet has a first wrap portion disposed around only a top face, a bottom face, a front face, a rear face, and a left face. The second shingle packet has a second wrap portion disposed around only a top face, a bottom face, a front face, a rear face, and a right face. The third shingle packet has a wrap portion disposed around only a top face, a bottom face, a front face, and a rear face.

BRIEF DESCRIPTION OF THE DRAWINGS

These and other features and advantages of the present invention will become better understood with regard to the following description and accompanying drawings in which.

DETAILED DESCRIPTION

Prior to discussing the various embodiments, a review of the definitions of some exemplary terms used throughout the disclosure is appropriate. Both singular and plural forms of all terms fall within each meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Figure 1:
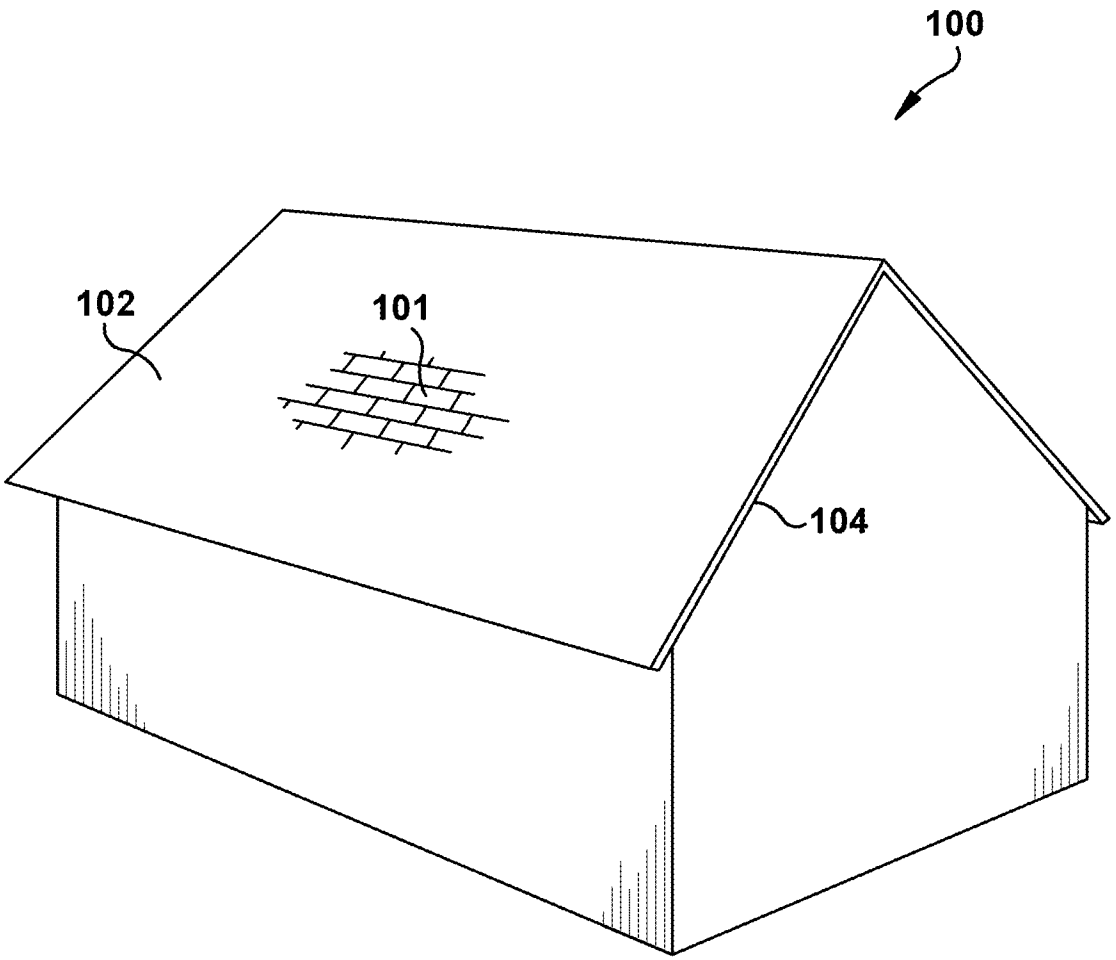
FIG. 1 is a perspective diagram of a roof of a residential home.

Referring now to FIG. 1, a diagram of a roof structure 100 is shown. The roof 100 is a shingled roof, covered with individual shingles 101. The sides 102 of the roof 100 come together to form a ridge at the top of the roof 100 that extends to rake edges 104 and a gable end. The shingles 101 of the roof 100 are applied in courses on top of an optional underlayment (not shown) and sheeting and/or decking (not shown). The shingles 101 may be single-layer three-tab shingles, or may be laminate shingles, such as the shingles described in U.S. Pat. Nos. 8,430,983 and 9,121,178, which are incorporated herein by reference in their entirety.

Figure 2A:
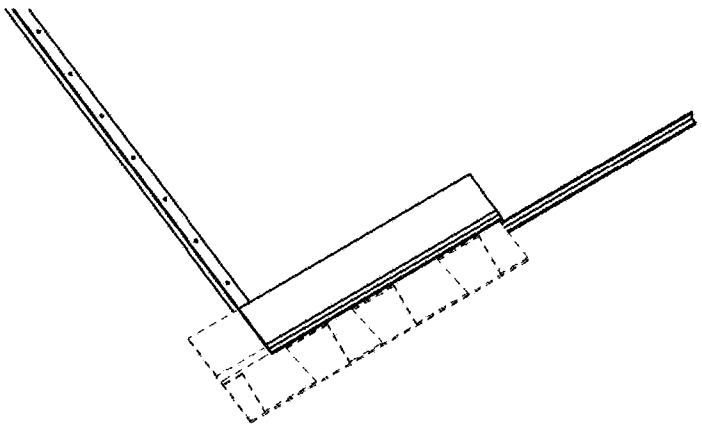
Fig. 2A (Prior Art)
FIGS. 2A-2H illustrate the steps to cut prior art offset shingles.
Figure 2B:
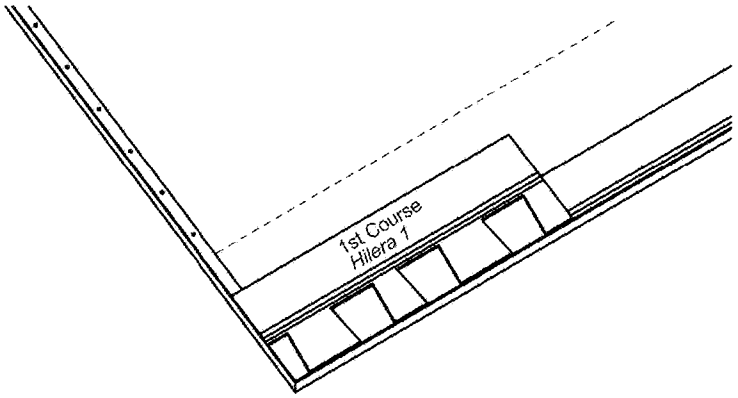
Fig. 2B (Prior Art)
Figure 2C:
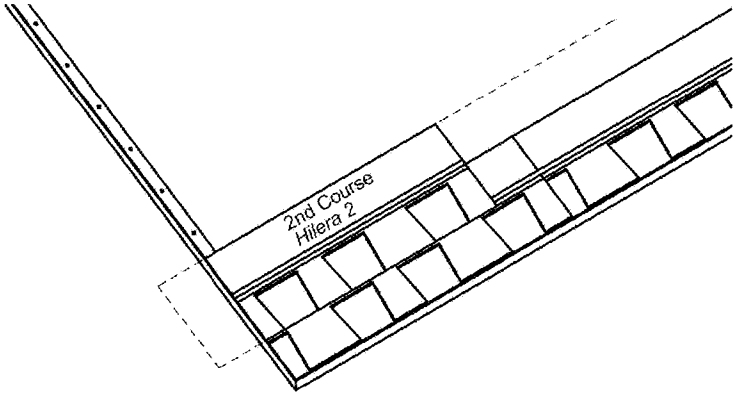
Fig. 2C (Prior Art)
Figure 2D:
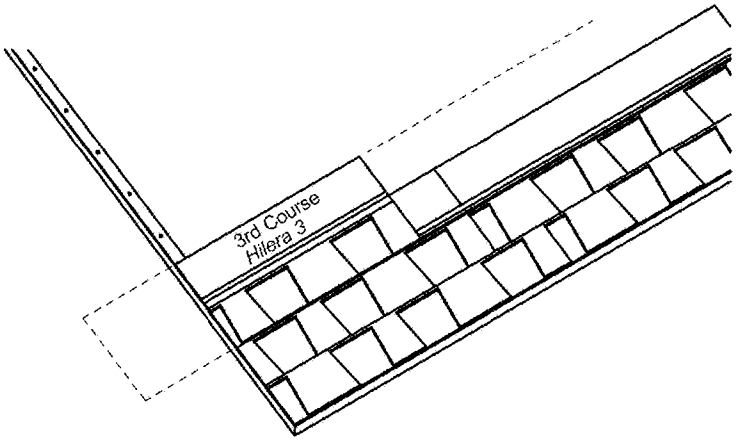
Fig. 2D (Prior Art)
Figure 2F:
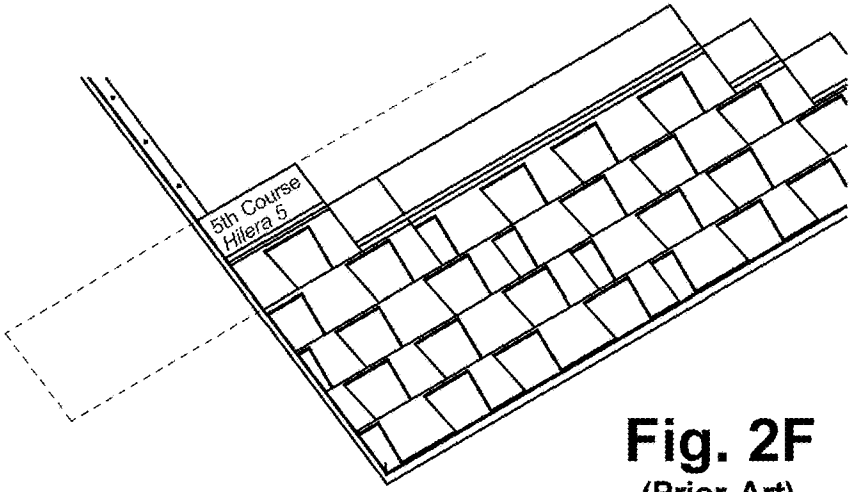
Fig. 2F (Prior Art)
Figure 2H:
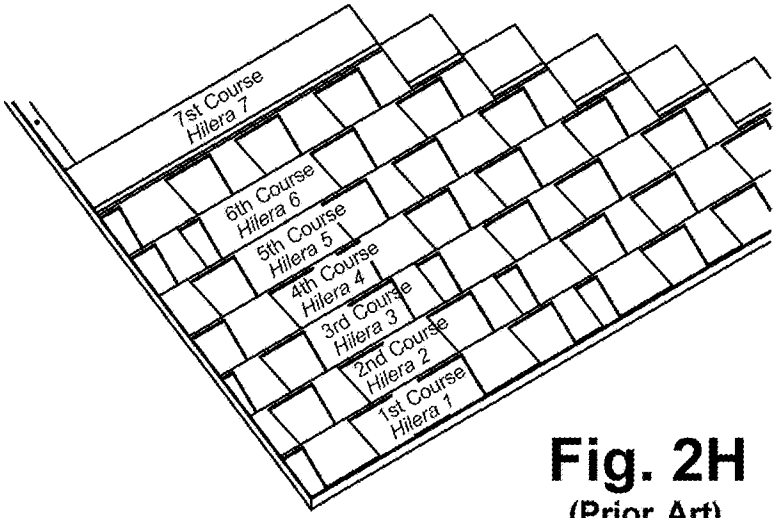
Fig. 2H (Prior Art)
Figure 2E:
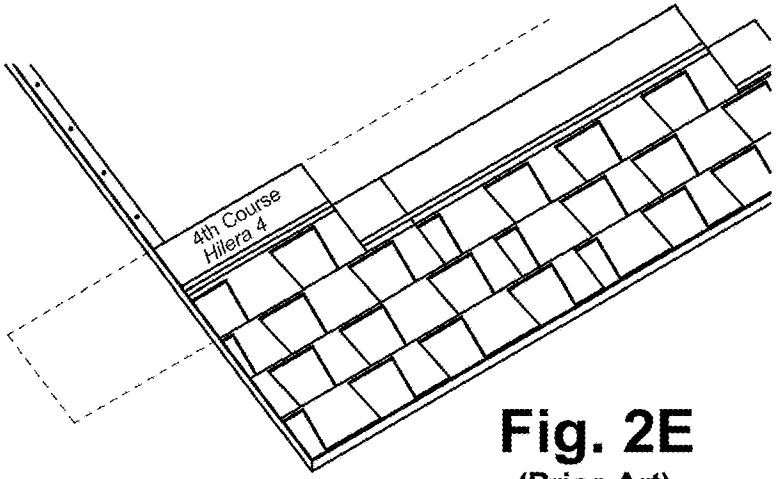
Fig. 2E (Prior Art)
Figure 2G:
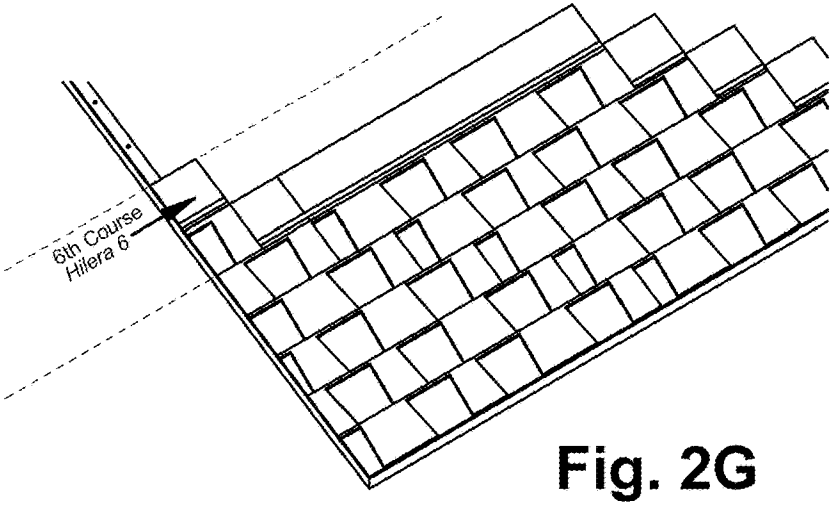
Fig. 2G (Prior Art)

Referring now to FIGS. 2A-2H, steps to apply prior art shingles are shown. A starter course is first applied along the bottom edge of the roof. The starter course is similar to the headlap portion of a shingle or may be the headlap portion of a shingle with the tab portion removed, as shown in FIG. 2A. The first course of shingles is applied on top of the starter course, starting with a full width shingle at the rake edge of the roof as shown in FIG. 2B. To start the second and subsequent courses, a shingle is cut to a reduced width to form an offset shingle to start the course, as shown in FIGS. 2C-2G. Full width shingles are then applied to complete the course (the last shingle in the course being cut to fit the opposing rake edge, valley, hip, etc.). The width of the offset shingle is typically decremented for each course by a set distance, such as, for example, 6.5 inches, 5 inches, or 4 inches, or some other distance that can be divided into the full width of the shingle with little or no remainder. After the smallest offset shingle is used, a full width shingle is typically used to start the next course, as shown in FIG. 2H.

Typically, the measuring and cutting of offset shingles is done manually by the installer of the roof. Straight cuts are difficult to make when up on a rooftop, so many installers will cut the shingles at a cutting station at the ground level to achieve a straight cut. This results in multiple trips up and down a ladder to measure and cut the shingles during installation. In some cases, to avoid trips up and down the ladder, an installer may install full width shingles and let them hang over the rake edge of the roof, cutting the excess shingle material off after a number of courses have been completed. Cutting after installation can damage the edge of the roof, and results in excess material falling to the ground that needs to be cleaned up and is typically wasted. Applicant has appreciated the need for prefabricated offset shingles that can be easily formed out of full width shingles without cutting or measuring to increase the speed and accuracy of installing offset courses of shingles on a rooftop.

Figure 3:
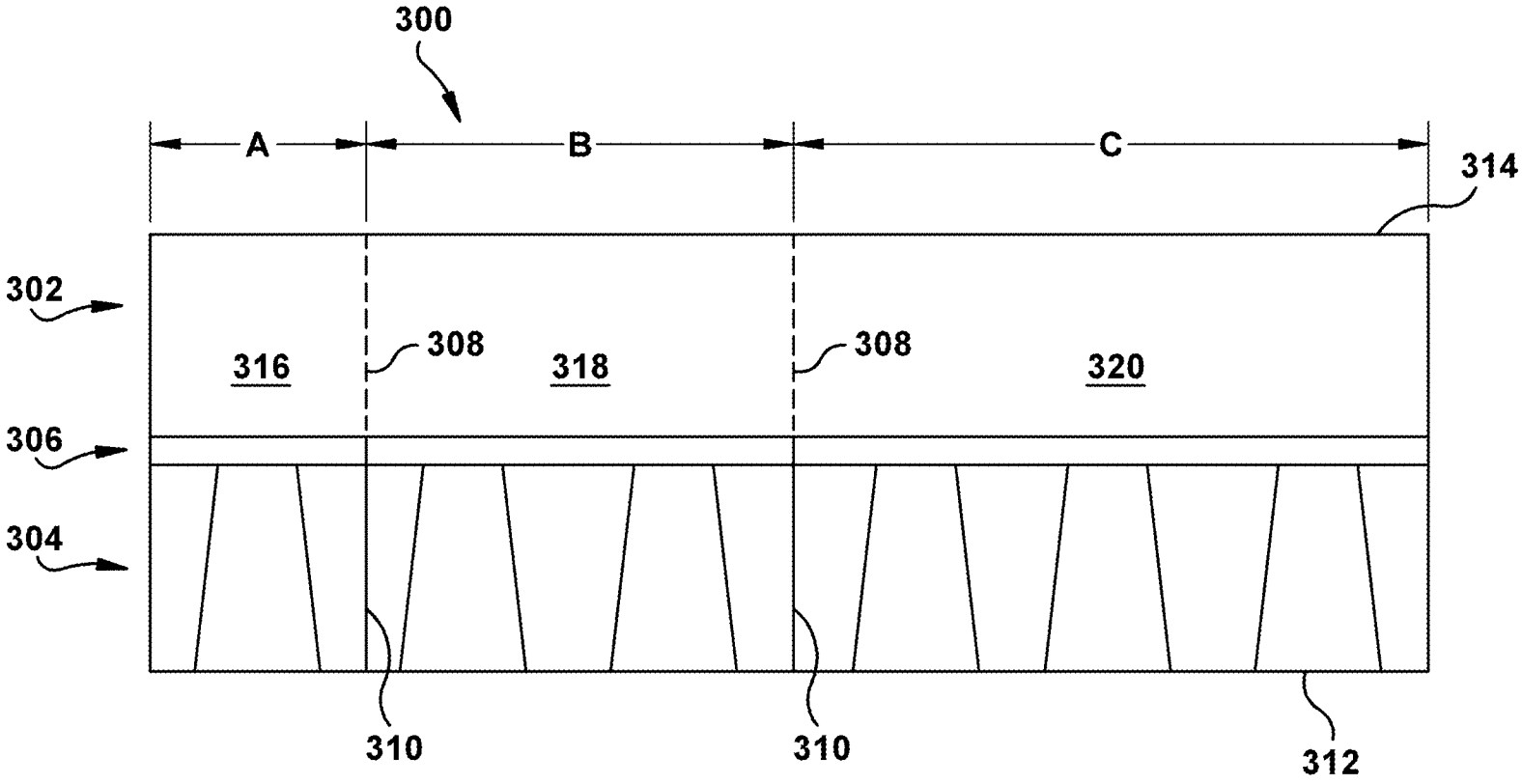
FIG. 3 is a plan view of an exemplary tearable prefabricated offset shingle.

Referring now to FIG. 3, an exemplary prefabricated offset shingle 300 is shown. The shingle 300 extends between first and second side edges and includes a headlap portion 302, a tab portion 304, and a nail zone 306. Transverse cuts 310 extend from a bottom edge 312 through the tab portion 304 and nail zone 306. Frangible lines of weakness 308 in line with the transverse cuts 310 extend from the cuts 310 to a top edge 314 of shingle 300. The lines of weakness 308 may be perforations of various lengths, or may be a portion of the shingle that is thinner and thus easier to cut or tear. The cuts and lines of weakness 310, 308 separate the shingle 300 into first, second, and third offset portions 316, 318, 320. The offset portions 316, 318, 320 can be easily separated from each other by folding the shingle 300 along the lines of weakness 308 back and forth until the portions 316, 318, 320 separate. Alternatively, the lines of weakness 308 may be scored or cut. When cutting along the lines of weakness 308, the perforations help to guide a blade or other cutting device along a straight line.

The cuts 310 are spaced apart to form a first offset portion 316 having a width A, a second offset portion 318 having a width B, and a third offset portion 320 having a width C. In the illustrated embodiment, width A is one-sixth of the width of the full width shingle 300, width B is one-third (two-sixths) of the width of the full width shingle 300, and width C is one-half (three-sixths) of the width of the full width shingle 300. In some embodiments, the shingle 300 has a width of about 39 inches. In some embodiments, width A is about 6.5 inches, width B is about 13 inches, and width C is about 19.5 inches.

Figure 3A:
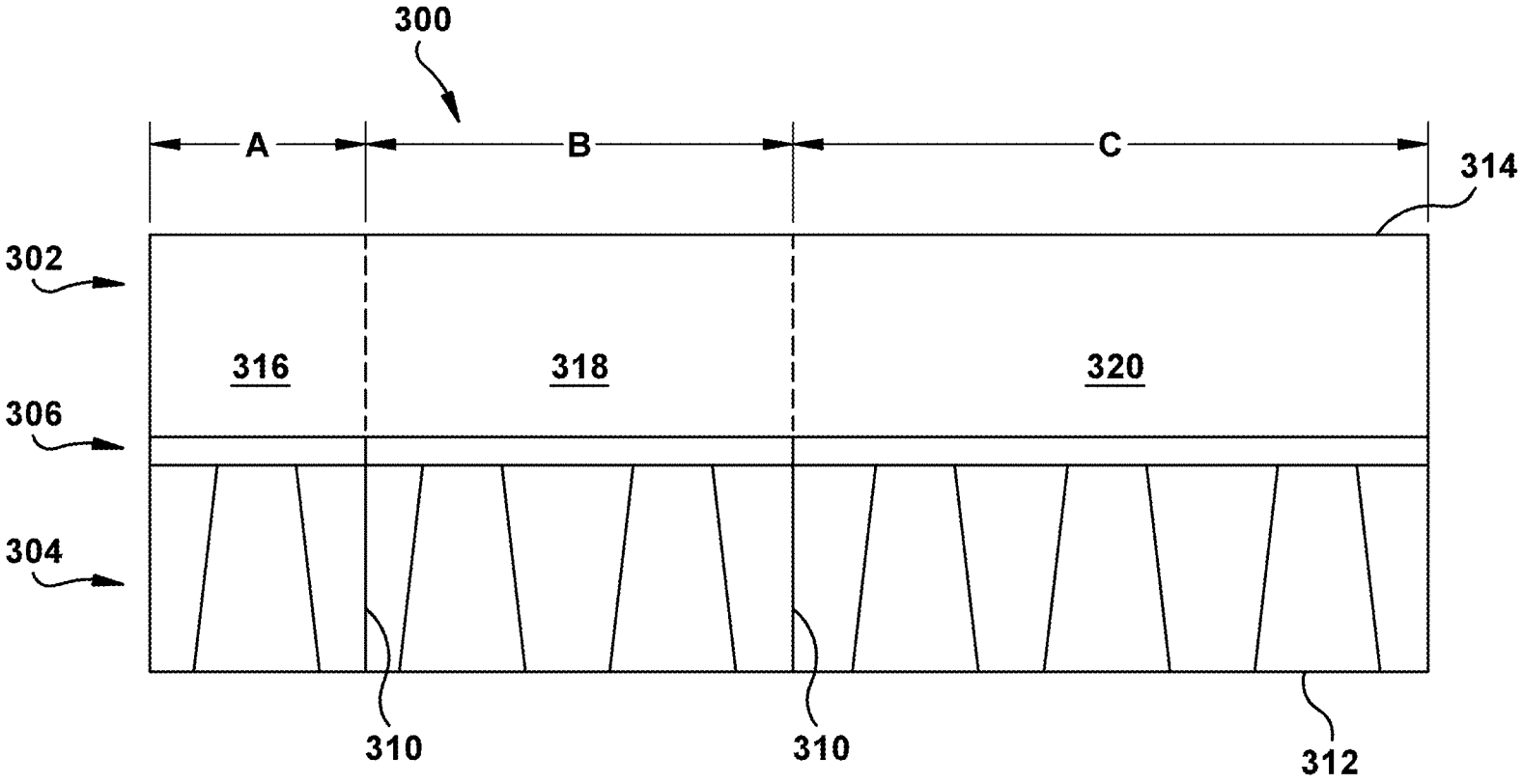
FIG. 3A is a plan view of an exemplary pre-cut prefabricated offset shingle.
Figure 4A:
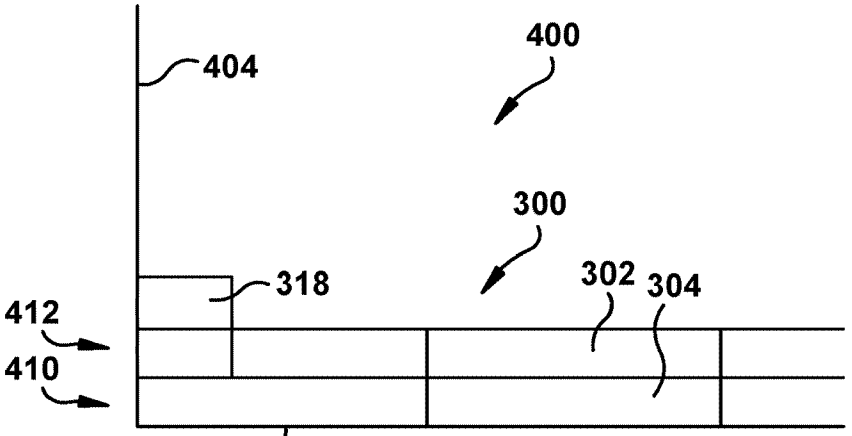
FIGS. 4A-4D illustrate the layout of shingle courses using exemplary prefabricated offset shingles.
Figure 4B:
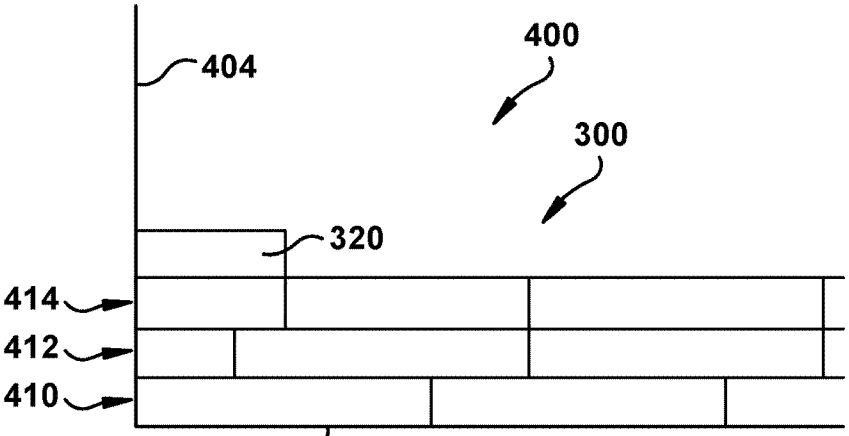
Figure 4C:
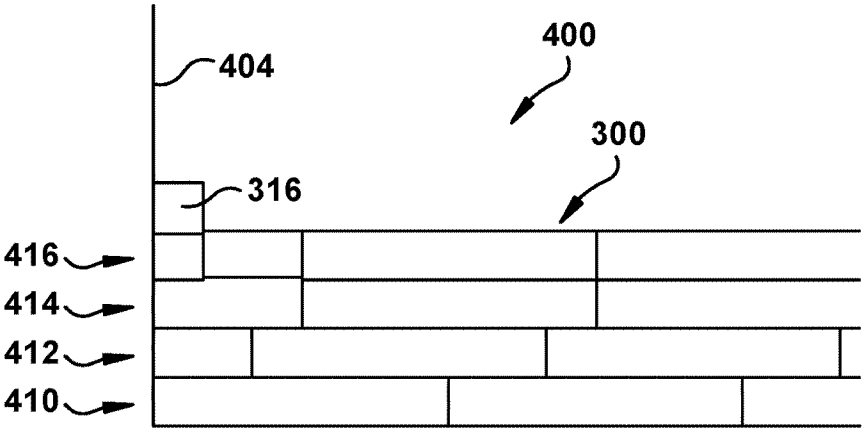
Figure 4D:
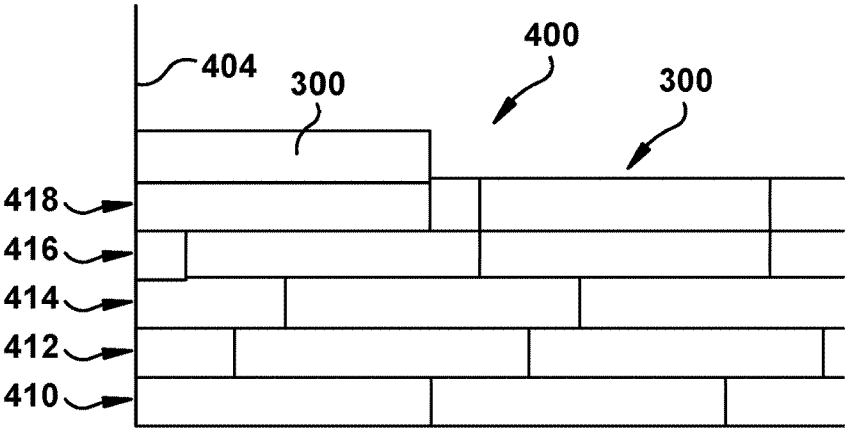

FIG. 3A illustrates an exemplary prefabricated offset shingle 300 that is the same as the embodiment of FIG. 3, except the shingle is completely pre-cut. That is, the transverse cuts 310 extend from a bottom edge 312 to the top edge 314 and the lines of weakness 308 are not included.

The offset portions may also be described as "steps" as they form a stair-step pattern when the offset shingles are attached to the roof in descending size order, i.e., starting with the largest step or offset on the first course, then the next smallest step, then the next smallest, etc. In the embodiment illustrated in FIG. 3, the offset shingle can be separated into three steps having three different sizes: small 316 (having width A), medium 318 (having width B), and large 320 (having width C). In an exemplary embodiment of an offset shingle having three steps, a formula is used to calculate a length $X_L$ of the longest shingle step (C in the example of FIG. 3), for a specified offset distance Y (corresponding to the smallest step A in the example of FIG. 3). The smallest step has a length $X_S$ and the medium step has a length $X_M$, with $X_S$ being equal to the offset distance Y, and $X_S$ being narrower than $X_M$ which in turn is narrower than $X_L$. The steps or offset shingles are made from an individual shingle having a given width of L, as is the case in the examples of FIGS. 3 and 3A. For most roofs of residential homes, the offset distance Y has practical bounds: at the lower end, the offset should be greater than about 2 inches to prevent water from penetrating the roof; and at the upper end, the offset should be less than or equal to about 6½ inches so that the smallest offset piece has a reasonable length. That said, larger offset distances may be desirable in buildings that are of a larger scale so that the shingle sizes maintain an appropriate aesthetic proportion with the rest of the structure.

The formula to calculate the longest off-set shingle piece length, $X_L$, is calculated in the following way. First, the total length L is defined as the sum of the step lengths, $X_L$, $X_M$, and $X_S$, as shown by Equation 1, below.

$$L=X_L+X_M+X_S \quad \text{(Equation 1)}$$

The relationship between the small and medium steps or offset portions can be defined in terms of the longest step and the offset length as follows:

$$X_M=X_L-Y \quad \text{(Equation 2); and}$$

$$X_S=X_L-2Y \quad \text{(Equation 3).}$$

These relationships are then substituted into Equation 1 which can be solved for $X_L$, thereby defining $X_L$ in terms of L and Y, which are known values:

$$L=X_L+(X_L-Y)+(X_L-2Y)$$

Solving for $X_L$ shows that:

$$X_L=L/3+Y$$

The small and medium steps, $X_S$ and $X_M$, can also be redefined in terms of L and Y by substituting this definition of $X_L$ into Equations 2 and 3 shown above.

$$X_M=L/3; \text{ and}$$

$$X_S=L/3-Y.$$

Referring now to FIGS. 4A-4D, diagrams showing the steps to install roof shingles 300 on a roof 400 are shown. The roof 400 includes a drip edge 402 and a rake edge 404. A first course 410 of full width shingles 300 is installed along the drip or bottom edge 402 of the roof 400. To start the second course 412, a second offset portion 318 is formed from a shingle 300. The remainder of the second course 412 is then completed with full width shingles 300. To start the third course 414, a third offset portion 320 is formed from a shingle 300. The remainder of the third course 414 is then completed with full width shingles 300. To start the fourth course 416, a first offset portion 316 is formed from a shingle 300. The remainder of the fourth course 416 is then completed with full width shingles 300. The fifth course 418 has no offset and is started with a full width shingle 300. In some embodiments, the offset portions 316, 318, 320 are arranged such that the widest offset portion 320 is used in the second course 412, the medium width offset portion 318 is used in the third course 414, and the narrowest offset portion 316 is used in the fourth course 416, with the pattern being continued up the roof so that each series of offset shingles forms a stair step pattern.

Figure 5:
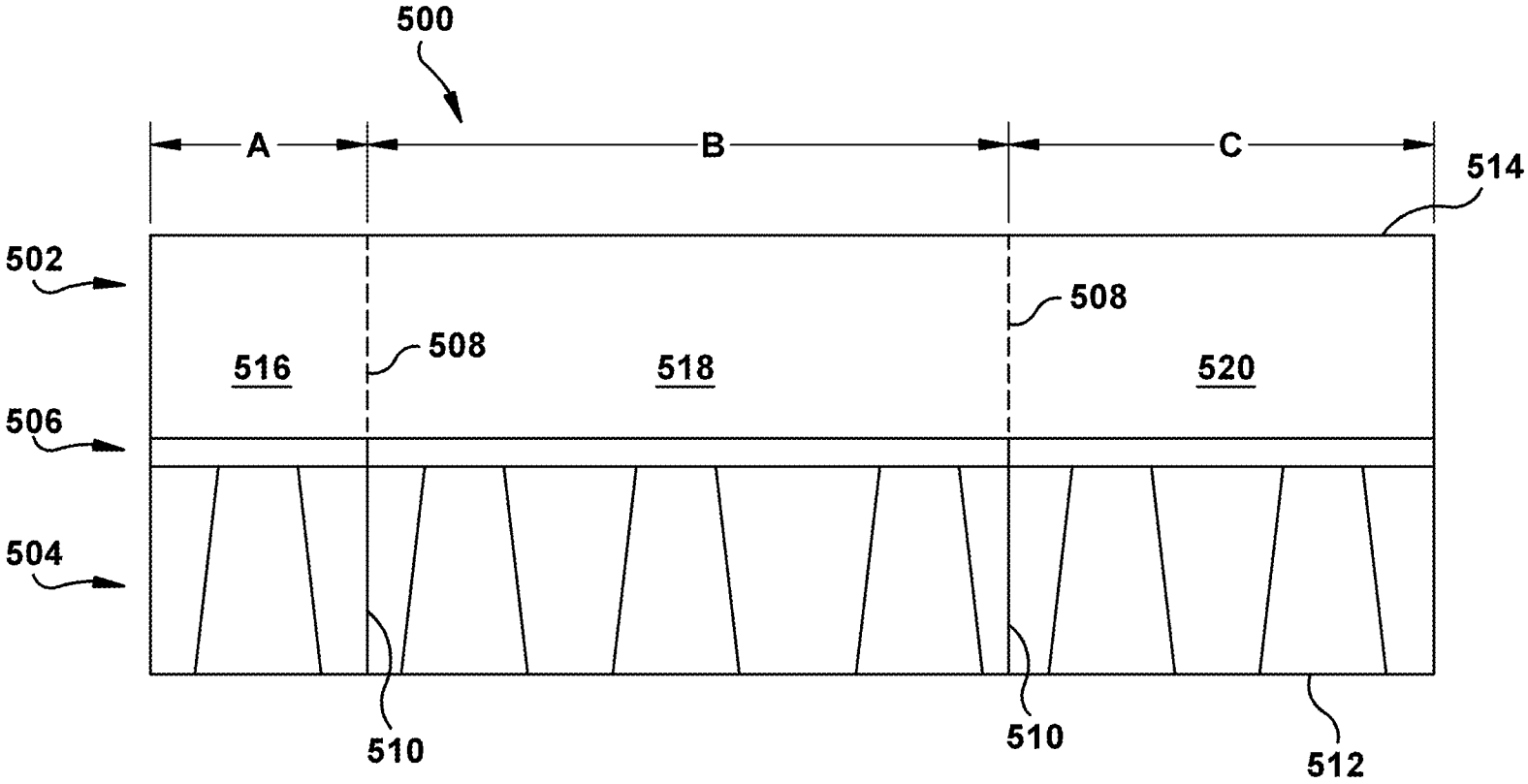
FIG. 5 is a plan view of an exemplary tearable prefabricated offset shingle.

Referring now to FIG. 5, an exemplary prefabricated offset shingle 500 is shown. The shingle 500 extends between first and second side edges and includes a headlap portion 502, a tab portion 504, and a nail zone 506. Transverse cuts 510 extend from a bottom edge 512 through the tab portion 504 and nail zone 506. Frangible lines of weakness 508 in line with the transverse cuts 510 extend from the cuts 510 to a top edge 514 of shingle 500. The lines of weakness 508 may be perforations of various lengths, or may be a portion of the shingle that is thinner and thus easier to cut or tear. The cuts and lines of weakness 510, 508 separate the shingle 500 into first, second, and third offset portions 516, 518, 520. The offset portions 516, 518, 520 can be easily separated from each other by folding the shingle 500 along the lines of weakness 508 back and forth until the portions 516, 518, 520 separate. Alternatively, the lines of weakness 508 may be scored or cut. When cutting along the lines of weakness 508, the perforations help to guide a blade or other cutting device along a straight line.

The two cuts 510 and lines of weakness 508 are spaced apart to form a first offset portion 516 having a width A, a second offset portion 518 having a width B, and a third offset portion 520 having a width C. In the illustrated embodiment, width A is one-sixth of the width of the full width shingle 500, width B is one-half (three-sixths) of the width of the full width shingle 500, and width C is one-third (two-sixths) of the width of the full width shingle 500. In some embodiments, the shingle 500 has a width of about 39 inches. In some embodiments, width A is about 6.5 inches, width B is about 19.5 inches, and width C is about 13 inches.

While the widths of offset portions 516, 518, 520 are similar to the offset portions 316, 318, 320 of shingle 300, arranging the one-half width portion in the middle of the one-sixth and one-third width portions allows the installer to create offset shingles in each one-sixth width increment up to the full width of the shingle. This allows the offset amount per course of shingles to be the same for each course, as shown in FIGS. 2A-2H. Table 1 below lists the combinations of offset portions 516, 518, 520 that form each offset shingle.

TABLE 1

| Offset Width | Offset Portion Combinations |
|---|---|
| 1/6 | A |
| 2/6 | C |
| 3/6 | B |
| 4/6 | A + B |
| 5/6 | B + C |

Figure 5A:
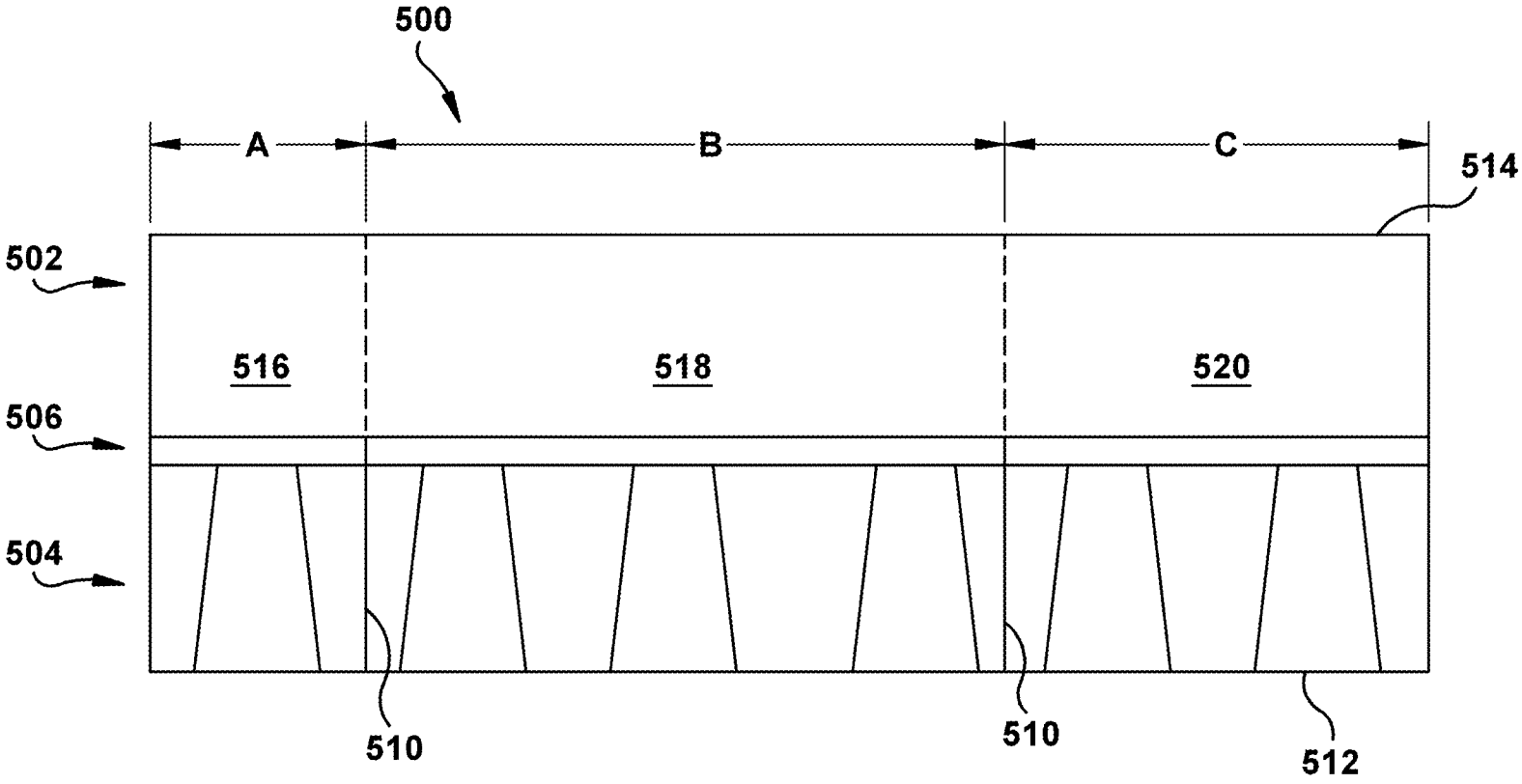
FIG. 5A is a plan view of an exemplary pre-cut prefabricated offset shingle.

FIG. 5A illustrates an exemplary prefabricated offset shingle 500 that is the same as the embodiment of FIG. 5, except the shingle is completely pre-cut. That is, the transverse cuts 510 extend from a bottom edge 512 to the top edge 514 and the lines of weakness 508 are not included.

Figure 6:
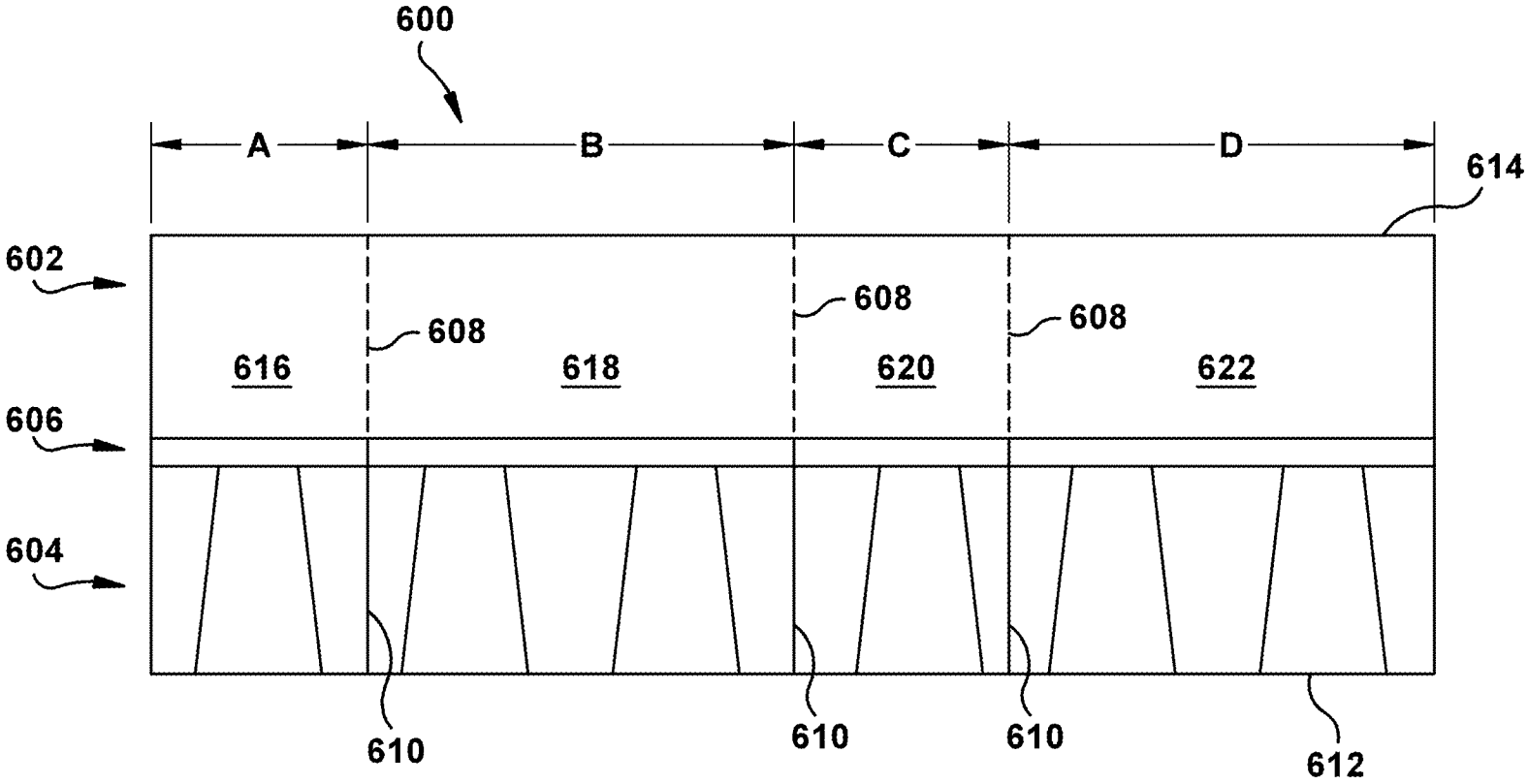
FIG. 6 is a plan view of an exemplary tearable prefabricated offset shingle.

Referring now to FIG. 6, an exemplary prefabricated offset shingle 600 is shown. The shingle 600 extends between first and second side edges and includes a headlap portion 602, a tab portion 604, and a nail zone 606. Transverse cuts 610 extend from a bottom edge 612 through the tab portion 604 and nail zone 606. Frangible lines of weakness 608 in line with the transverse cuts 610 extend from the cuts 610 to a top edge 614 of shingle 600. The lines of weakness 608 may be perforations of various lengths, or may be a portion of the shingle that is thinner and thus easier to cut or tear. The cuts and lines of weakness 610, 608 separate the shingle 600 into first, second, and third offset portions 616, 618, 620. The offset portions 616, 618, 620 can be easily separated from each other by folding the shingle 600 along the lines of weakness 608 back and forth until the portions 616, 618, 620 separate. Alternatively, the lines of weakness 608 may be scored or cut. When cutting along the lines of weakness 608, the perforations help to guide a blade or other cutting device along a straight line.

The three cuts 610 and lines of weakness 608 are spaced apart to form a first offset portion 616 having a width A, a second offset portion 618 having a width B, a third offset portion 620 having a width C, and a fourth offset portion 622 having a width D. Widths A and C are equal, and widths B and D are equal. In the illustrated embodiment, widths A and C are one-sixth of the width of the full width shingle 600, and widths B and D are one-third (two-sixths) of the width of the full width shingle 600. In some embodiments, the shingle 600 has a width of about 39 inches. In some embodiments, widths A and C are about 6.5 inches, and widths B and D are about 13 inches.

Alternating the positions of the smaller and larger size shingles allows the installer to create offset shingles in each one-sixth width increment up to the full width of the shingle. This allows the offset amount per course of shingles to be the same for each course, as shown in FIGS. 2A-2H. Table 2 below lists the combinations of offset portions 616, 618, 620, 622 that form each offset shingle.

TABLE 2

| Offset Width | Offset Portion Combinations |
|---|---|
| 1/6 | A |
| 2/6 | D |
| 3/6 | A + B |
| 4/6 | A + B + C |
| 5/6 | B + C + D |

Figure 6A:
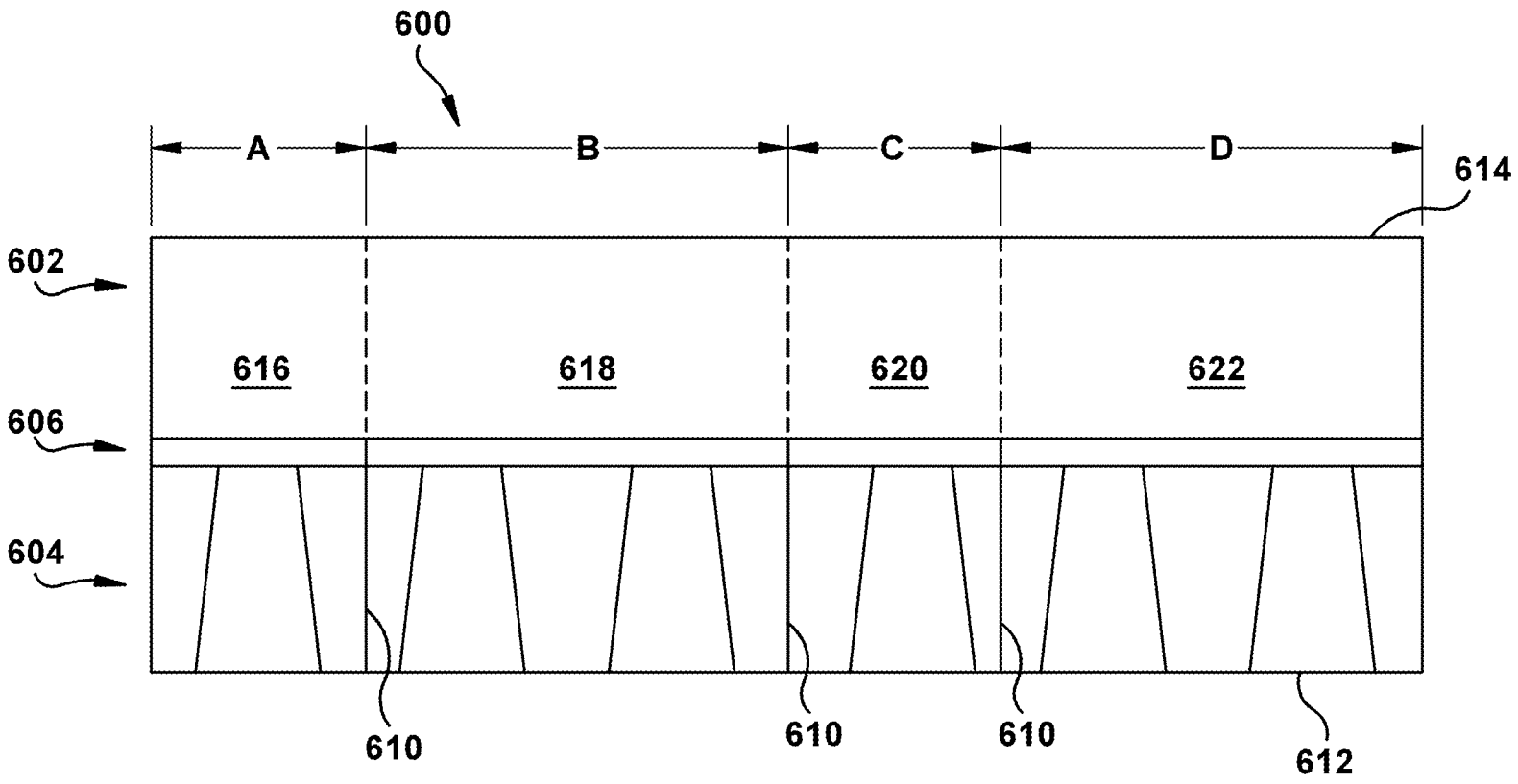
FIG. 6A is a plan view of an exemplary pre-cut prefabricated offset shingle.

FIG. 6A illustrates an exemplary prefabricated offset shingle 600 that is the same as the embodiment of FIG. 6, except the shingle is completely pre-cut. That is, the transverse cuts 610 extend from a bottom edge 612 to the top edge 614 and the lines of weakness 608 are not included.

Figure 7:
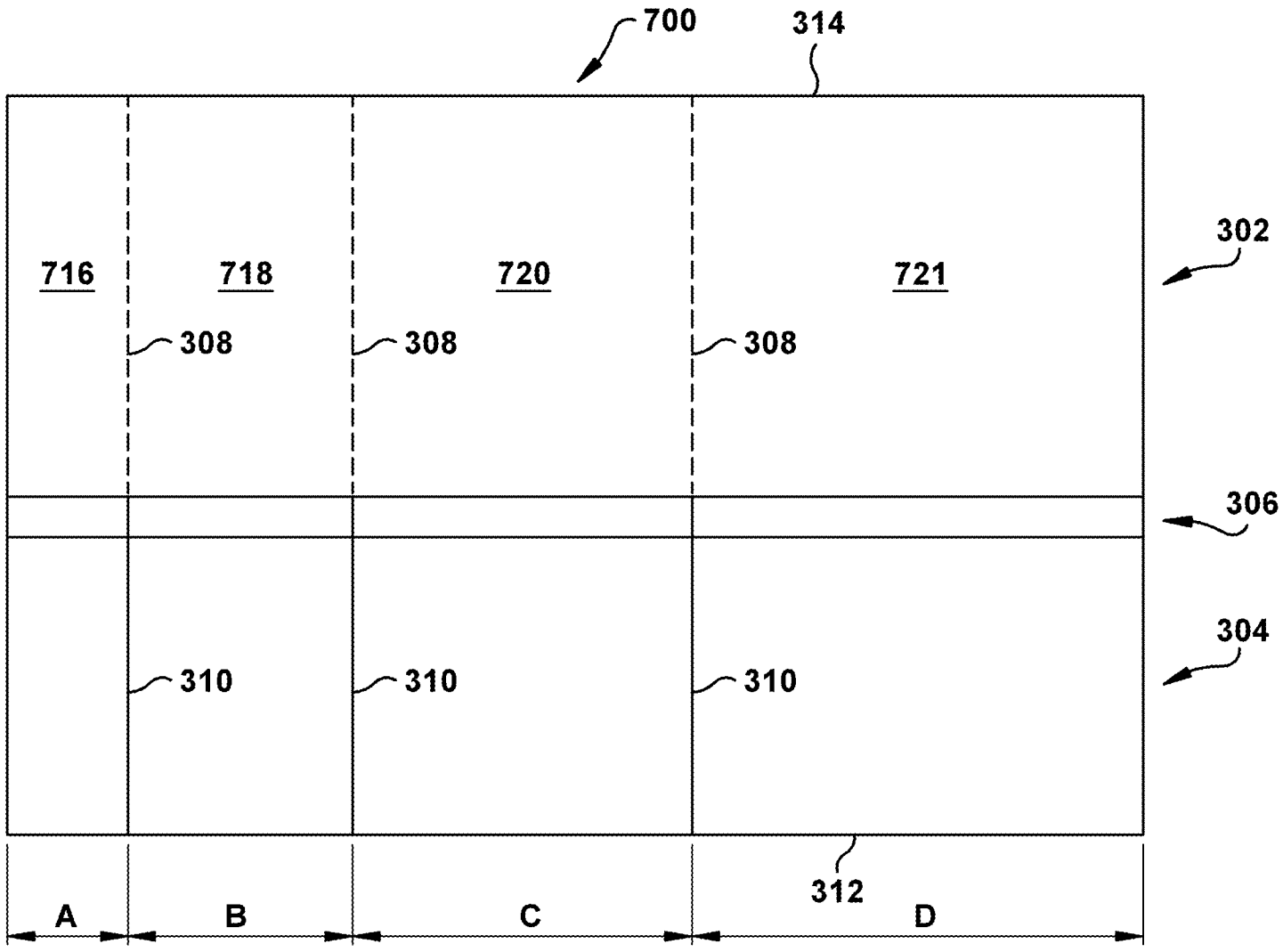
FIG. 7 is a plan view of an exemplary tearable prefabricated offset shingle.

Referring now to FIG. 7, an exemplary prefabricated offset shingle 700 is shown. The shingle 700 extends between first and second side edges and includes a headlap portion 702, a tab portion 704, and a nail zone 706. Transverse cuts 710 extend from a bottom edge 712 through the tab portion 704 and nail zone 706. Frangible lines of weakness 708 in line with the transverse cuts 710 extend from the cuts 710 to a top edge 714 of shingle 700. The lines of weakness 708 may be perforations of various lengths, or may be a portion of the shingle that is thinner and thus easier to cut or tear. The cuts and lines of weakness 710, 708 separate the shingle 700 into first, second, third and fourth offset portions 716, 718, 720, and 721. The offset portions 716, 718, 720, and 721 can be easily separated from each other by folding the shingle 700 along the lines of weakness 708 back and forth until the portions 716, 718, 720, and 721 separate. Alternatively, the lines of weakness 708 may be scored or cut. When cutting along the lines of weakness 708, the perforations help to guide a blade or other cutting device along a straight line.

The cuts 710 are spaced apart to form a first offset portion 716 having a width A, a second offset portion 718 having a width B, a third offset portion 720 having a width C, and a fourth offset portion 721 having a width D. In the illustrated embodiment, width A is one-tenth of the width of the full width shingle 700, width B is one-fifth (two-tenths) of the width of the full width shingle 700, width C is three-tenths of the width of the full width shingle 700, and width D is two-fifths (four-tenths) of the width of the full width shingle 700. In some embodiments, the shingle 700 has a width of about 39 or 40 inches. In some embodiments, width A is about 4 inches, width B is about 8 inches, width C is about 12 inches, and width D is about 16 inches.

Figure 7A:
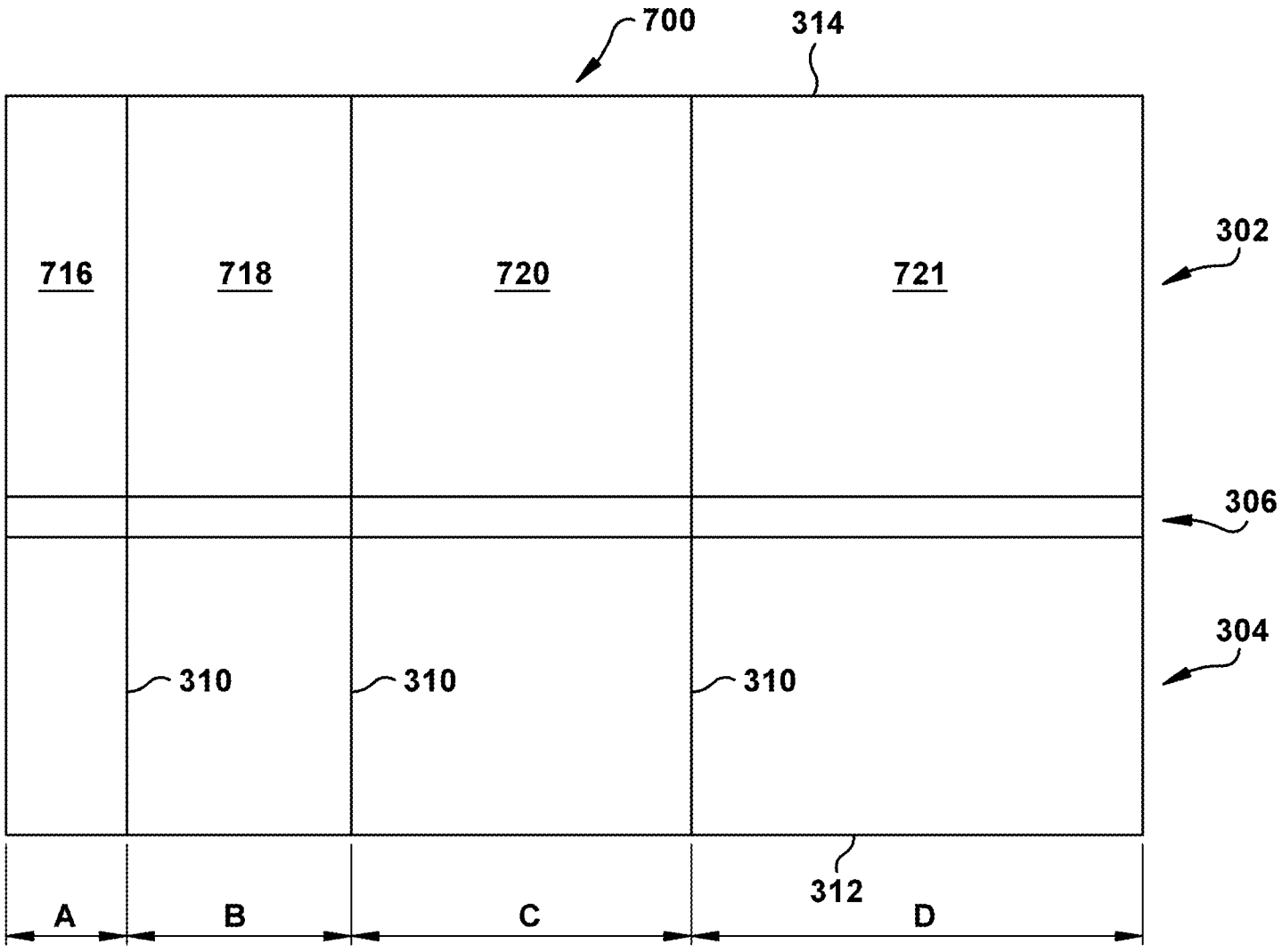
FIG. 7A is a plan view of an exemplary pre-cut prefabricated offset shingle.

FIG. 7A illustrates an exemplary prefabricated offset shingle 700 that is the same as the embodiment of FIG. 7, except the shingle is completely pre-cut. That is, the transverse cuts 710 extend from a bottom edge 712 to the top edge 714 and the lines of weakness 708 are not included.

The different portions of the prefabricated offset shingles illustrated by FIGS. 7 and 7A may be in any order. That is, the order may be varied in the same manner as described with respect to the embodiments of FIGS. 3, 3A, 5, 5A, 6, and 6A.

In the embodiment illustrated in FIGS. 7 and 7A, the offset shingle can be separated into four steps having four different sizes. In an exemplary embodiment of an offset shingle having four steps, a formula is used to calculate a length $X_D$ of the longest shingle step (D in the example of FIG. 7), for a specified offset distance Y (corresponding to the smallest step A in the example of FIG. 7). The other steps, in descending size order, have widths $X_C$, $X_B$, and $X_A$ (equal to offset Y). The steps or offset shingles are made from an individual shingle having a given width of L, as is the case in the examples of FIGS. 7 and 7A. For most roofs of residential homes, the offset distance Y has practical bounds: at the lower end, the offset should be greater than about 2 inches to prevent water from penetrating the roof; and at the upper end, the offset should be less than or equal to about 6½ inches so that the smallest offset piece has a reasonable length. That said, larger offset distances may be desirable in buildings that are of a larger scale so that the shingle sizes maintain an appropriate aesthetic proportion with the rest of the structure.

The formula to calculate the longest off-set shingle piece length, $X_L$, is calculated in the following way. First, the total length L is defined as the sum of the step lengths, $X_L$, $X_M$, and $X_S$, as shown by Equation 1, below.

$$L=X_A+X_B+X_C+X_D \quad \text{(Equation 1)}$$

The relationship between the small and medium steps or offset portions can be defined in terms of the longest step and the offset length as follows:

$$X_A=X_D-3Y \quad \text{(Equation 2);}$$

$$X_B=X_D-2Y \quad \text{(Equation 3); and}$$

$$X_C=X_D-Y \quad \text{(Equation 4).}$$

These relationships are then substituted into Equation 1 which can be solved for $X_L$, thereby defining $X_L$ in terms of L and Y, which are known values:

$$L=(X_D-3Y)+(X_D-2Y)+(X_D-Y)+X_D$$

Solving for $X_D$ shows that:

$$X_D=(L+6Y)/4$$

The smaller steps, $X_A$, $X_B$, and $X_C$, can also be redefined in terms of L and Y by substituting this definition of $X_D$ into Equations 2, 3, and 4 shown above.

$$X_A=(L-6Y)/4;$$

$$X_B=(L-2Y)/4; \text{ and}$$

$$X_C=(L+2Y)/4.$$

While the prefabricated offset shingles 300, 500, 600, and 700 described above have offset portions of different widths, the offset portions may be the same width and be formed by cuts that are uniformly spaced across the width of the shingle. Furthermore, the different sized portions do not have to be multiples of the smallest portion—e.g., one-sixth of the width of the shingle. For example, a small offset portion may be 15 percent of the width of the full width shingle, a medium offset portion may be 35 percent of the width of a full width shingle, and a large offset portion may be 50 percent of the width of a full width shingle.

Figure 8A:
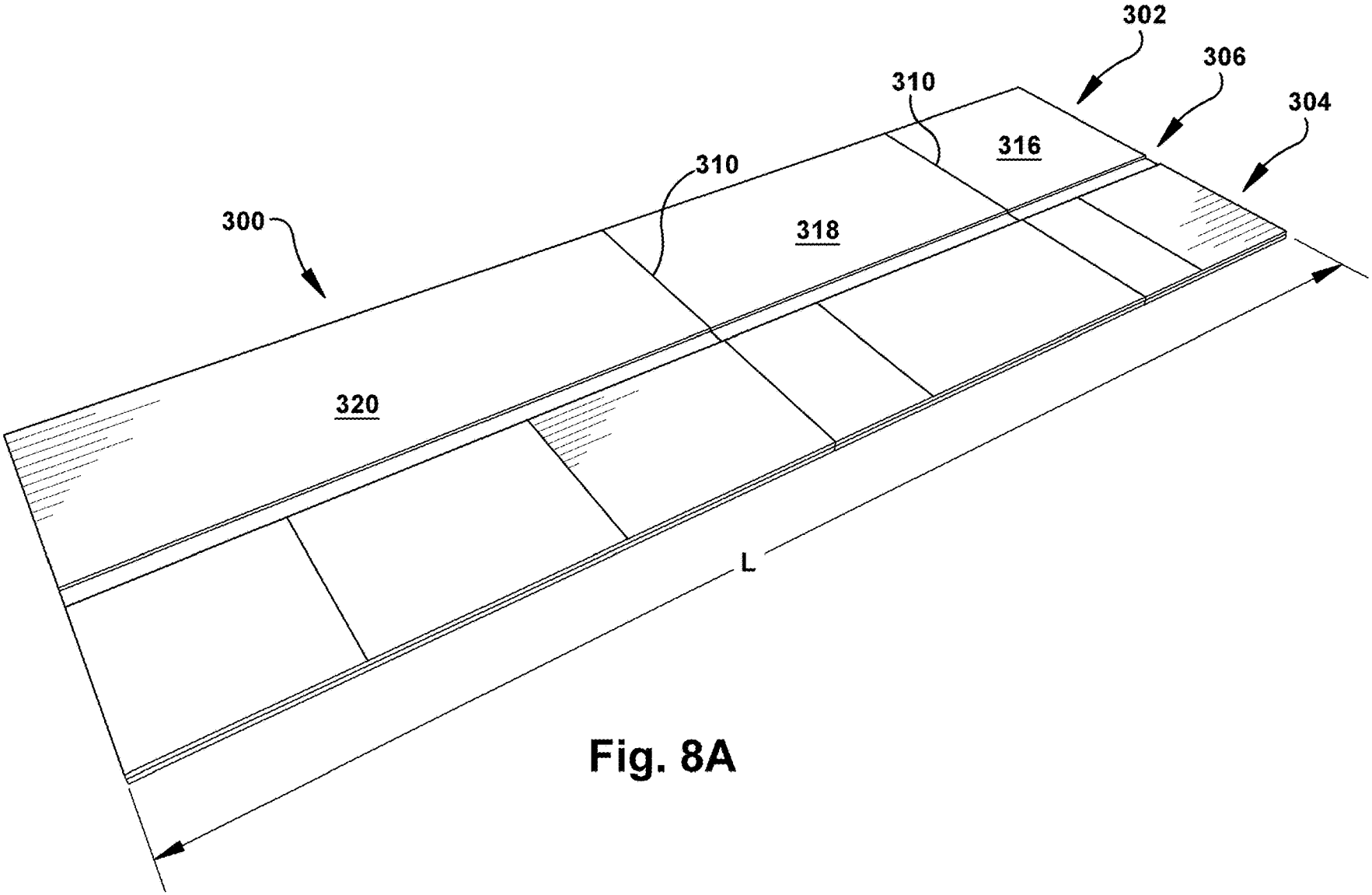
FIGS. 8A-8G illustrate packaging of pre-cut prefabricated offset shingles.
Figure 8B:
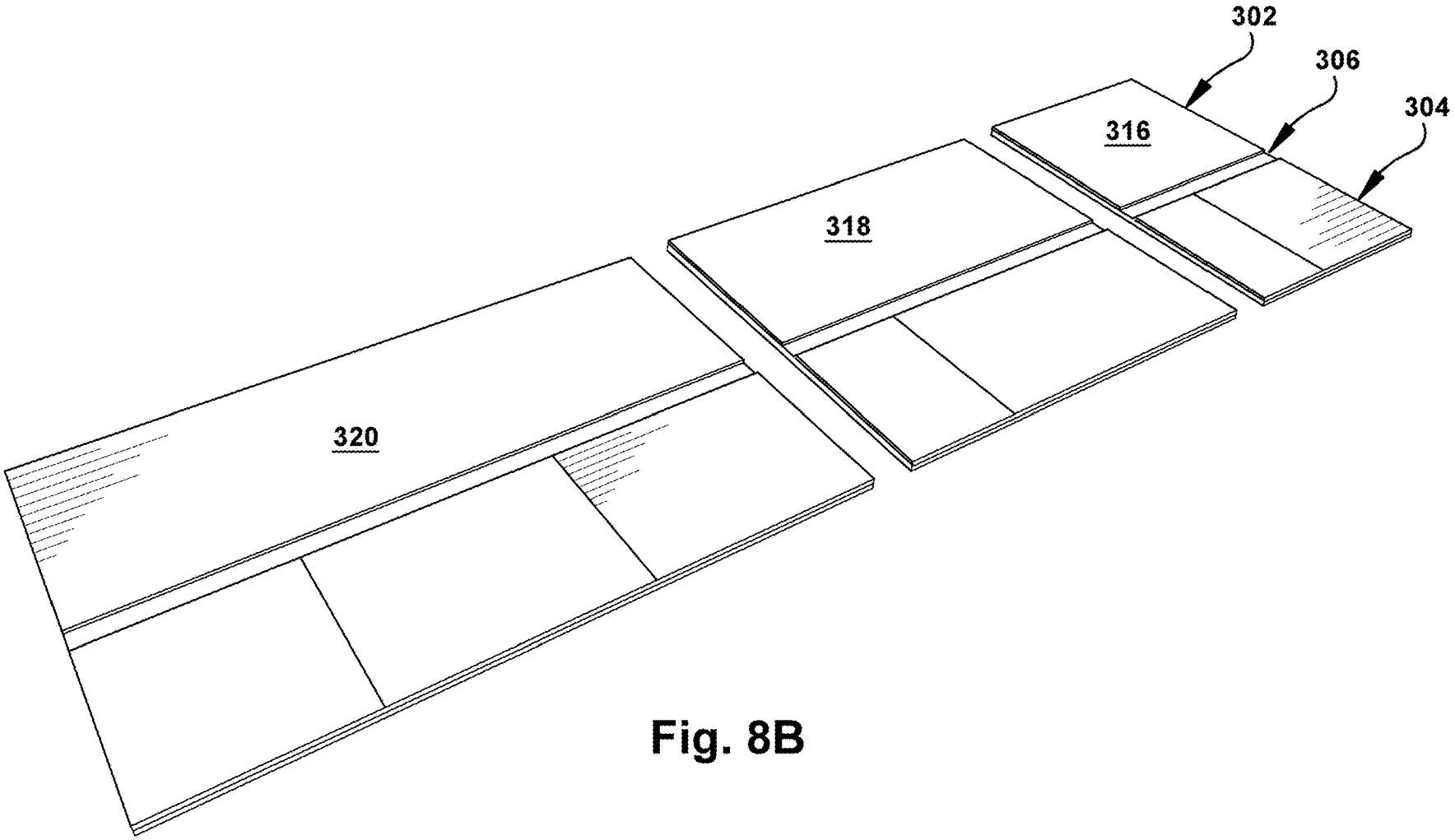

The pre-cut prefabricated shingles illustrated by FIGS. 3A, 5A, 6A, and 7A may be packaged in a box having an interior length L/2 that is approximately one-half the length L of the shingle 300. FIGS. 8A and 8B illustrate the shingle 300 cut and separated into segments 316, 318, and 320. The segment 320 is one-half the length L or about one-half the length L of the shingle. The combined length of the segments 316, 318 is also one-half the length L or about one-half the length L of the shingle 300.

Figure 8C:
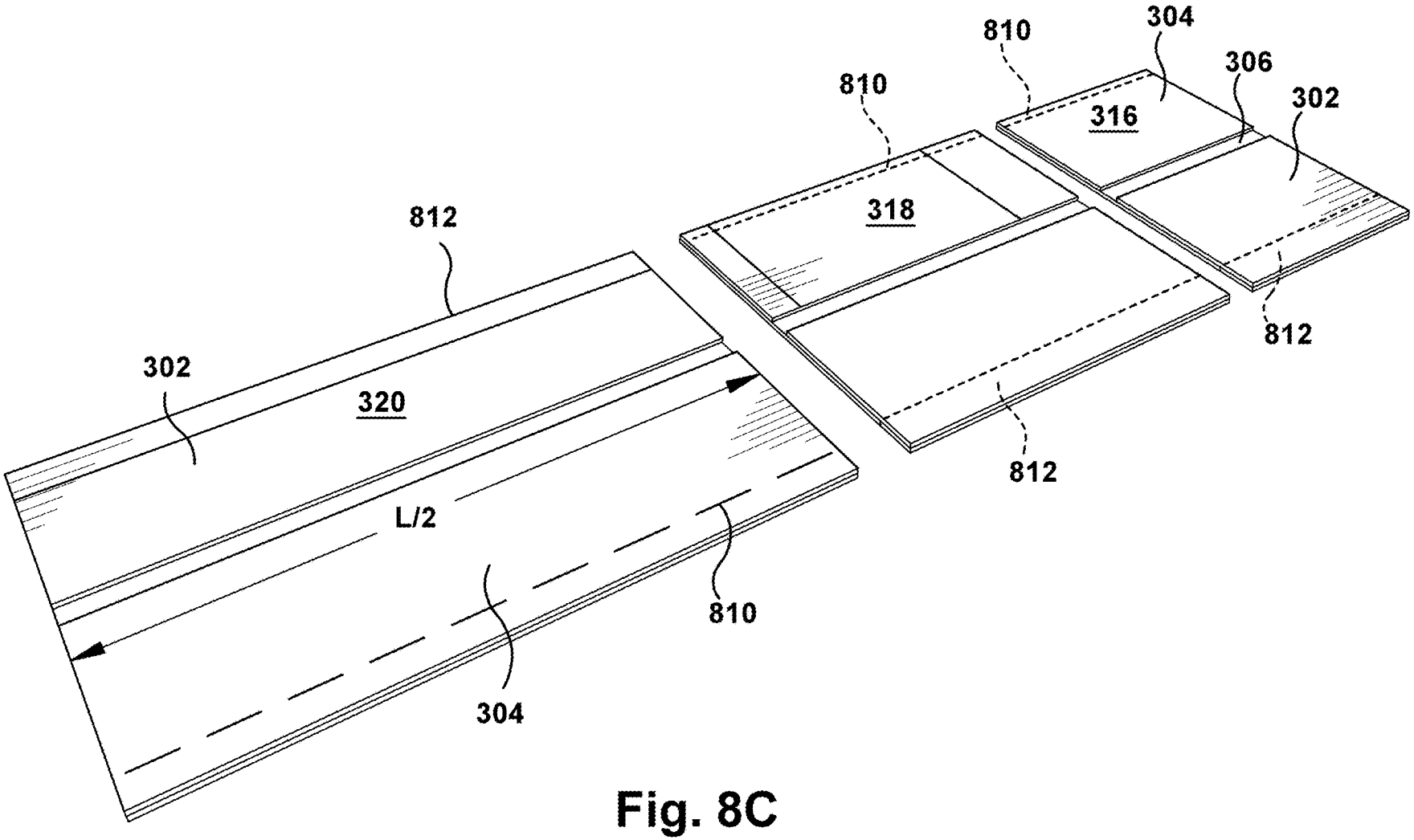
Figure 8D:
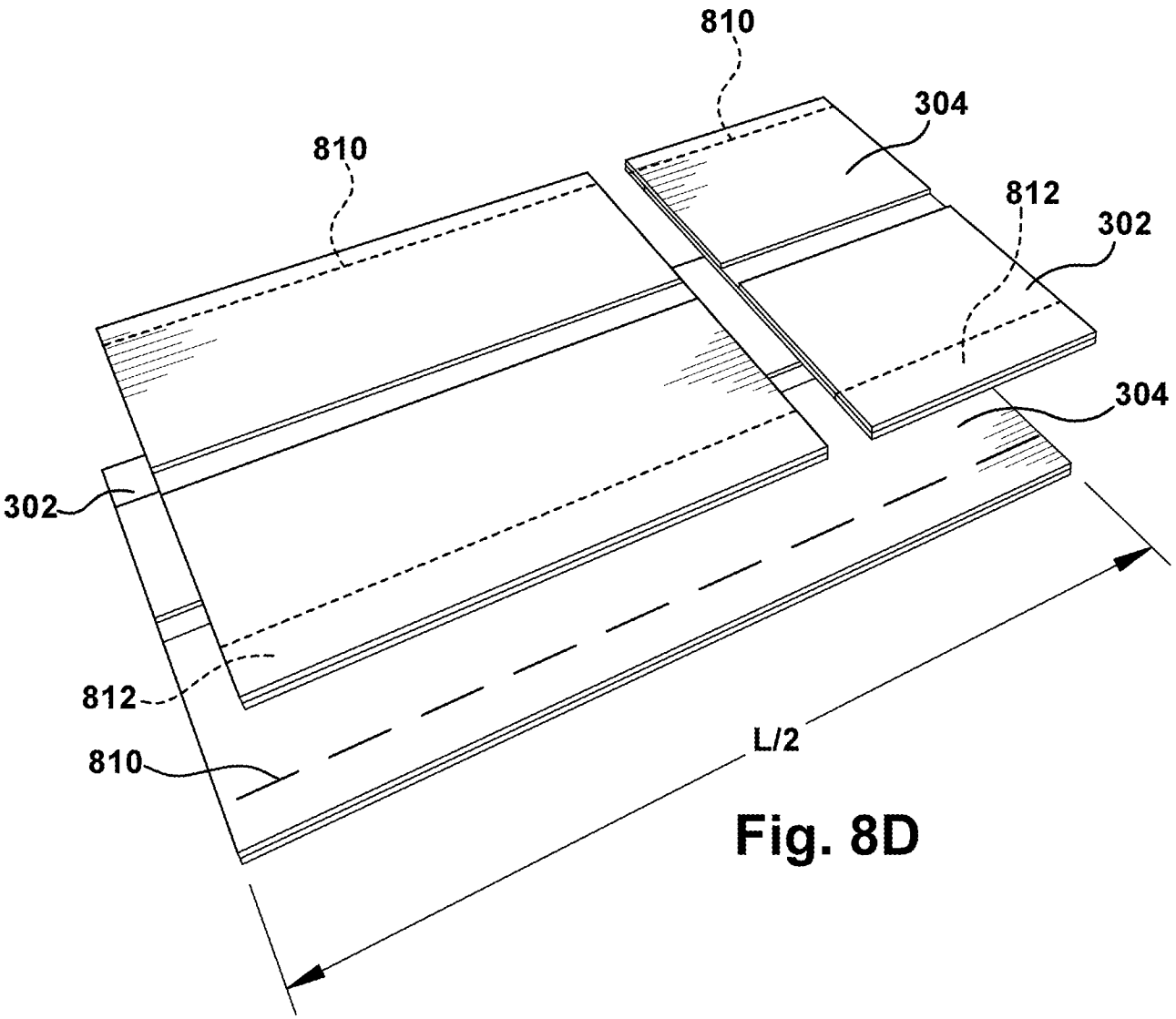
Figure 8E:
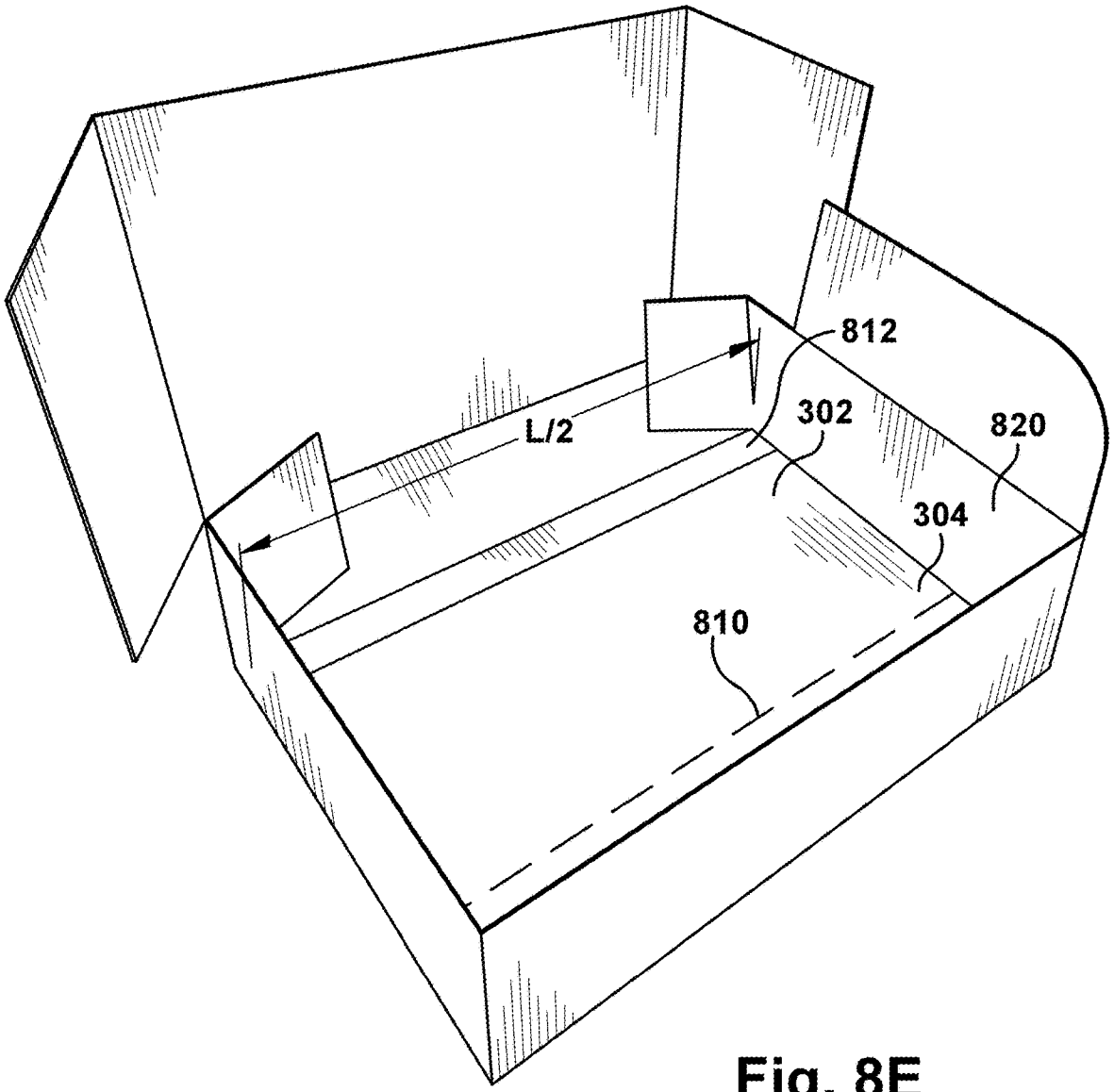
Figure 8F:
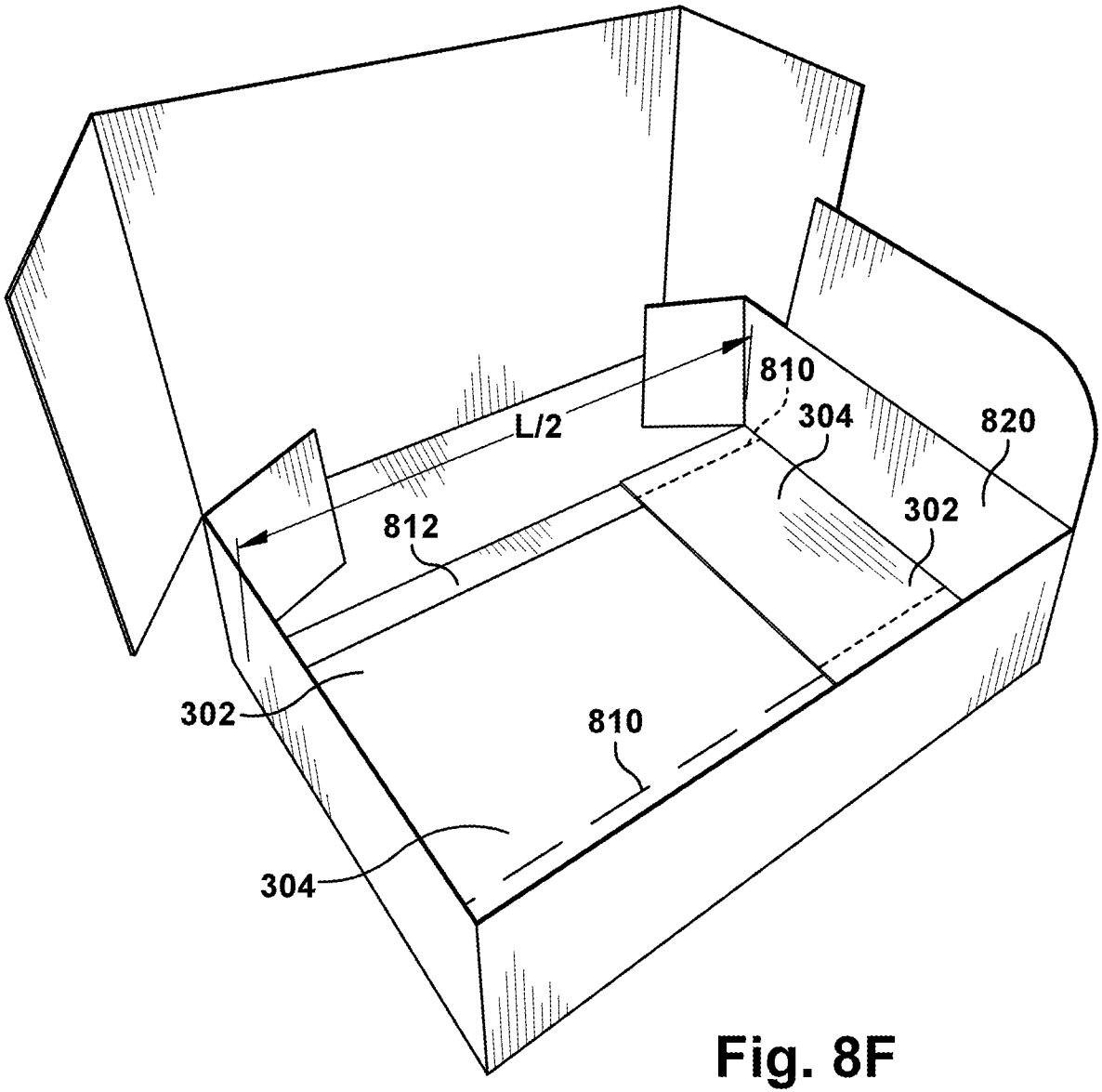
Figure 8G:
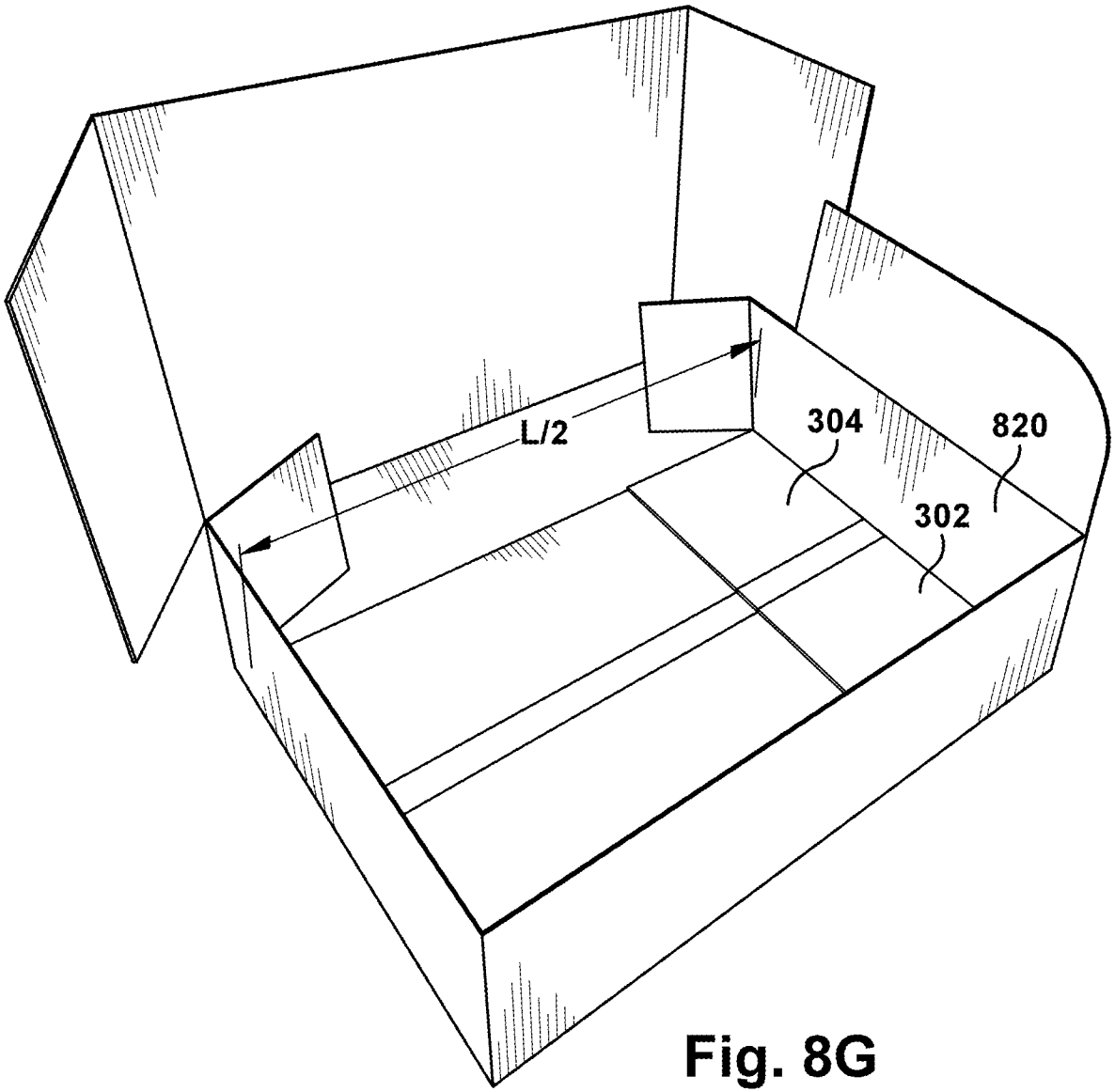

Referring now to FIGS. 8C and 8D, a rear surface of the shingle segments 316, 318, 320 has a sealant 810 proximate the bottom edge and a release tape 812 proximate the top edge. In FIGS. 8C and 8D, the segment 320 is flipped over, so that a sealant 810 of the segment 320 is aligned with the release tape 812 of the segments 316, 318 and the sealant 810 of the segments 316, 318 is aligned with the release tape 812 of segment 320. Referring to FIGS. 8E-8G, the shingle 300 is placed in the box 820 in this release tape/sealant aligned orientation. As such, each shingle 300 can be placed in the illustrated two-layer stack in a box having an interior length L/2 that is one-half or about one-half the length L of the shingle 300. Additional shingles can be stacked in the box in this configuration to fill the box.

The shingle 700 illustrated by FIG. 7A may also be packaged in a box having an interior length L/2 that is approximately one-half the length L of the shingle 300. FIG. 7A illustrates the shingle 700 cut and separated into segments 716, 718, 720, and 721. The combined lengths of the segments 716 and 721 is one-half the length L or about one-half the length L of the shingle 700. The combined length of the segments 718, 720 is also one-half the length L or about one-half the length L of the shingle 700. Each pair (716-721 and 718-720) of shingle segments can be oriented and stacked in the box 820 in the same manner illustrated by FIGS. 8E-8G. The sealant 810 of each shingle segment is aligned with the release tape 812 of each opposing shingle segment to prevent the shingle segments from sticking together.

Figure 9A:
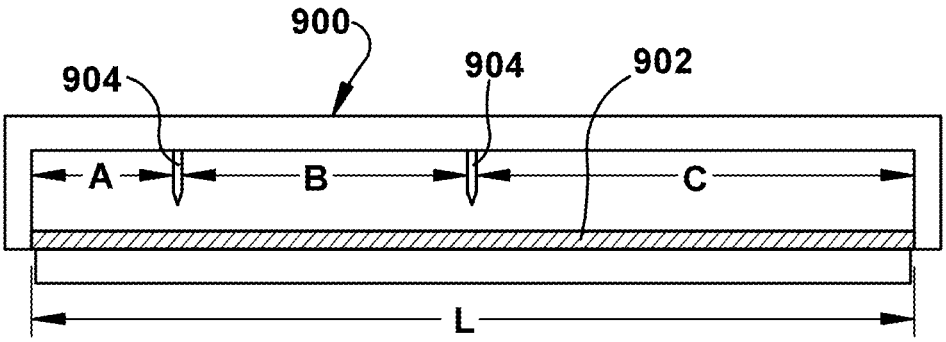
FIGS. 9A-9C illustrate an exemplary embodiment of a cutter for making offset shingles from a traditional shingle.
Figure 9B:
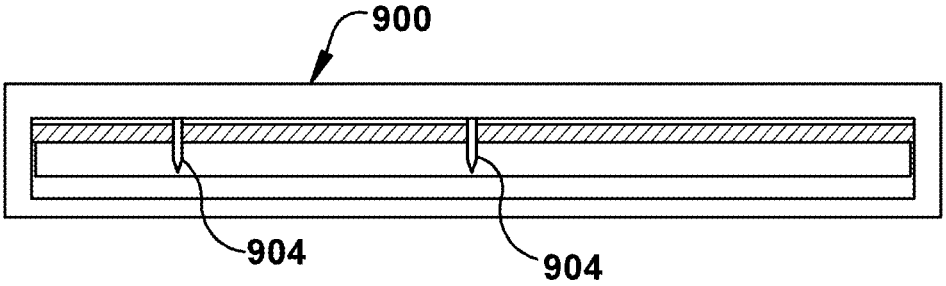
Figure 9C:
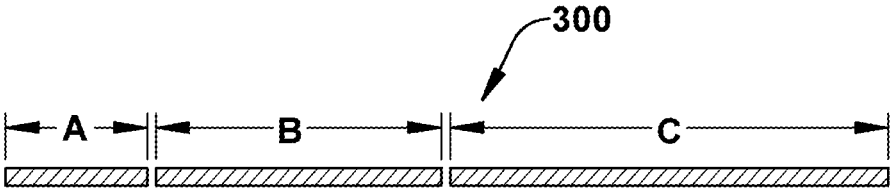

The shingles disclosed by the present application can be made in a wide variety of different ways. Referring to FIG. 9A, a shingle blank 902 having a length L may be provided to a cutter 900. The cutter 900 includes spaced apart blades 904. The blades 904 may be configured to make any of the cuts and lines of weakness described in this patent application. The number of blades and spacing of the blades 904 may be set to the size of each offset segment. For example, the number of blades and spacing may correspond to the sizes A, B, and C of FIGS. 3 and 3A as illustrated, the number of blades and spacing of FIG. 5, 5A, 6, 6A, 7, or 7A or any other offset shingle configuration. Referring to FIG. 9B, the cutter 900 moves the blades 904 to cut the blank 902 into the segments. Referring to FIG. 9C, the segments are then released from the cutter.

Figure 10A:
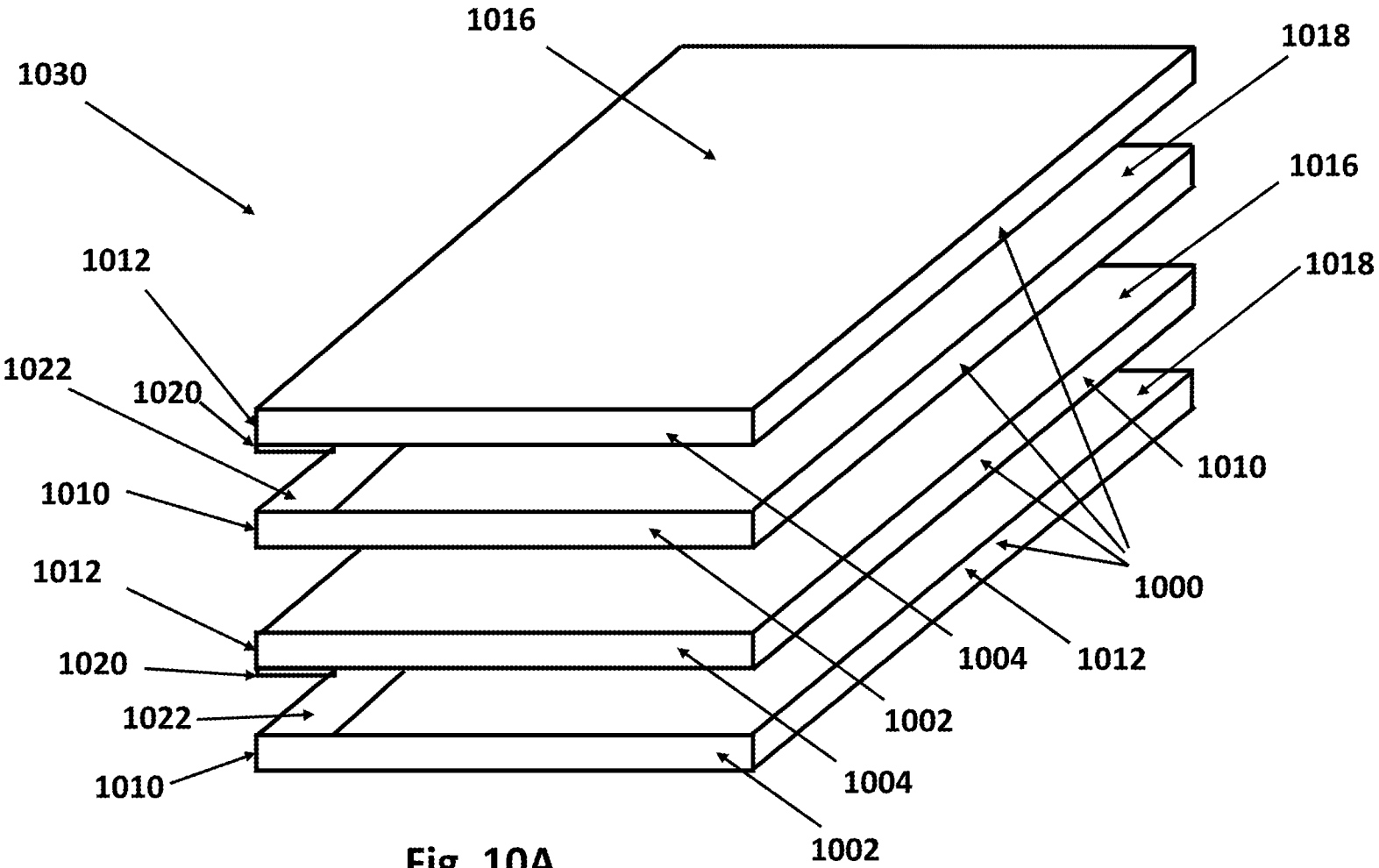
FIG. 10A is a left-front-top perspective view of an exploded shingle assembly.

Turning to FIGS. 10A through 13, one or more prefabricated shingles 1000 may be arranged into a shingle assembly 1030 and wrapped with a packaging or wrap 1050. Each shingle 1000 has a front surface 1016, a rear surface 1018 opposite the front surface 1016. Each shingle 1000 extends between a first side edge 1002 and a second side edge 1004 opposite the first side 1002 and includes a top edge 1010 and a bottom edge 1012. As described above, the shingles 1000 may also include a headlap portion which terminates in the top edge 1010, a tap portion which terminates in the bottom edge 1012, and a nail zone. As shown in FIG. 10A, the rear surface 1018 of each shingle 1000 may include a sealant 1020 proximate the bottom edge 1012 and a release tape 1022 proximate the top edge 1010. However, it will be appreciated that the shingles 1000 may not have a sealant and/or a release tape. In the embodiment illustrated in FIG. 10A, the bottom-most shingle 1000 and the shingle 1000 third from the bottom are flipped over along either the top or bottom edge 1010, 1012, as detailed below.

Figure 10B:
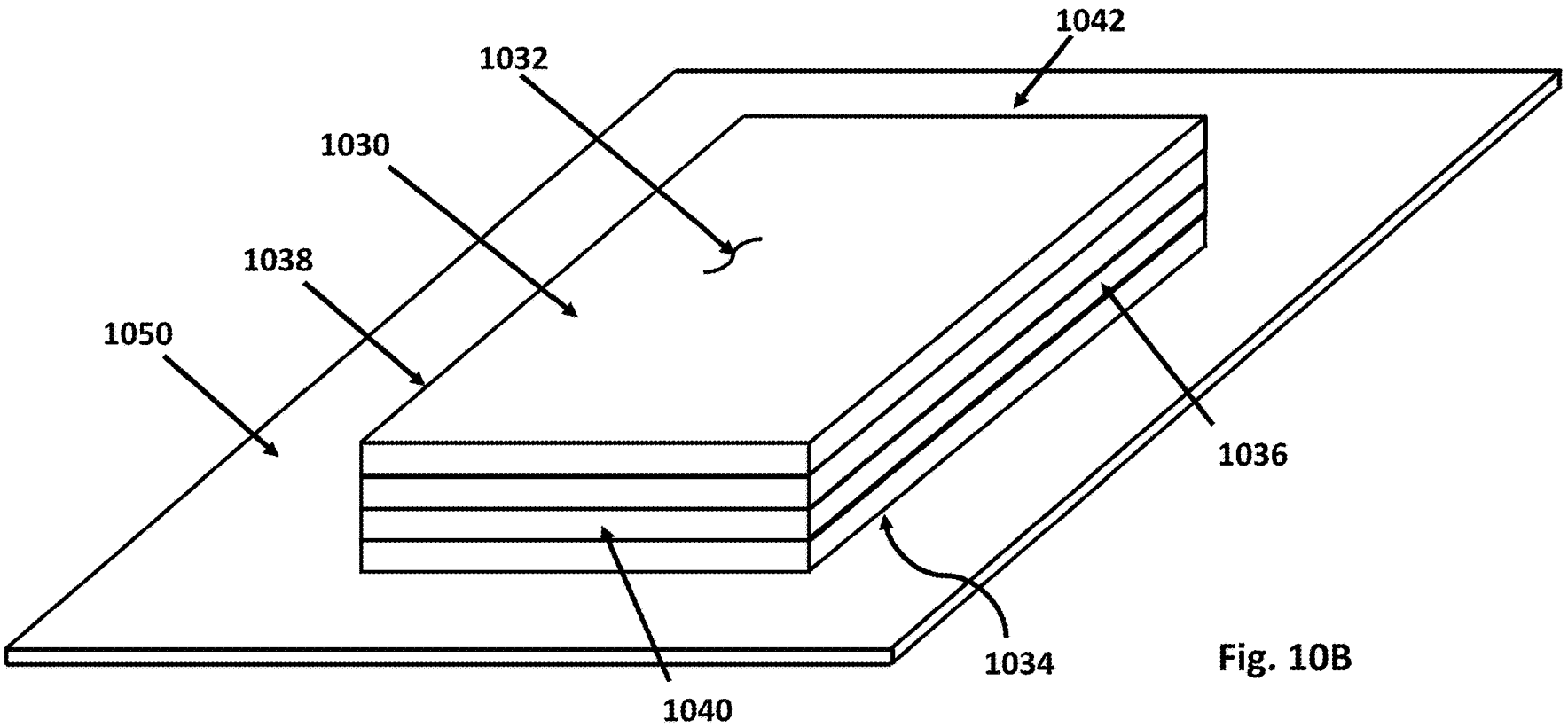
FIG. 10B is a left-front-top perspective view of the shingle assembly of FIG. 10A and a wrap.

As shown in FIGS. 10A and 10B, two or more shingles 1000 may be stacked, arranged, or otherwise disposed to form a shingle assembly 1030 having a top face 1032, a bottom face 1034, a front face 1036, a rear face 1038, a left side 1040, and a right side 1042. The terms left side and right side merely describe the position of the respective sides of the shingle assembly 1030 in FIG. 10A and may be switched. While the illustrated shingle assembly 1030 has four shingles 1000, the shingle assembly 1030 may have two, three, five, ten, or twenty or more shingles 1000.

In the illustrated embodiment, the shingles 1000 are stacked on top of each other in alternating arrangements, similarly to the arrangements described and illustrated in FIGS. 8C and 8D. The bottom shingle 1000 is positioned with the rear surface 1018 facing upward and the subsequent shingle 1000 is flipped over so that the front surface 1016 is facing upward and the sealant 1020 of the bottom shingle 1000 is aligned with the release tape 1022 of the subsequent shingle 1000. Additional shingles 1000 may be stacked in this configuration to form the shingle assembly 1030.

In such an arrangement, the top face 1032 of the shingle assembly 1030 is the front surface 1016 of the top-most shingle 1030 in the shingle assembly 1030 and the bottom face 1034 of the shingle assembly 1030 is the front surface 1016 of the bottom-most shingle 1000 in the shingle assembly 1030. The front face 1036 of the shingle assembly 1030 includes the bottom edge 1012 of the bottom-most shingle 1000 and the top edge 1010 of the subsequent shingle 1000. The rear face 1038 of the shingle assembly 1030 includes the top edge 1010 of the bottom-most shingle 1000 and the bottom edge 1012 of the subsequent shingle 1000. The left side 1040 of the shingle assembly 1030 includes the first side edge 1002 of the bottom-most shingle 1000 and the second side edge 1004 of the subsequent shingle 1000, and the right side 1042 of the shingle assembly includes the second side edge 1004 of the bottom-most shingle and the first side edge 1002 of the subsequent shingle 1000. Additional shingles 1000 can be added in a similar manner to increase the size of the shingle assembly 1030.

While the shingle assembly 1030 has been described as being composed of alternatingly oriented shingles 1000, it will be appreciated that the shingles 1000 may be arranged in the shingle assembly 1030 in any suitable manner. For example, in certain embodiments, such as where the shingles 1000 do not have a release tape or a sealant, or the release tape or shingle is in a different configuration, the shingles 1000 may be stacked with the front surface 1016 of each shingle 1000 oriented in the same direction such that the first side edge 1002, the second side edge 1004, the top edge 1010, and the bottom edge 1012 of each shingle 1000 in the shingle assembly 1030 are aligned with the first side edge 1002, the second side edge 1004, the top edge 1010, and the bottom edge 1012 of the other shingles 1000.

Figure 10C:
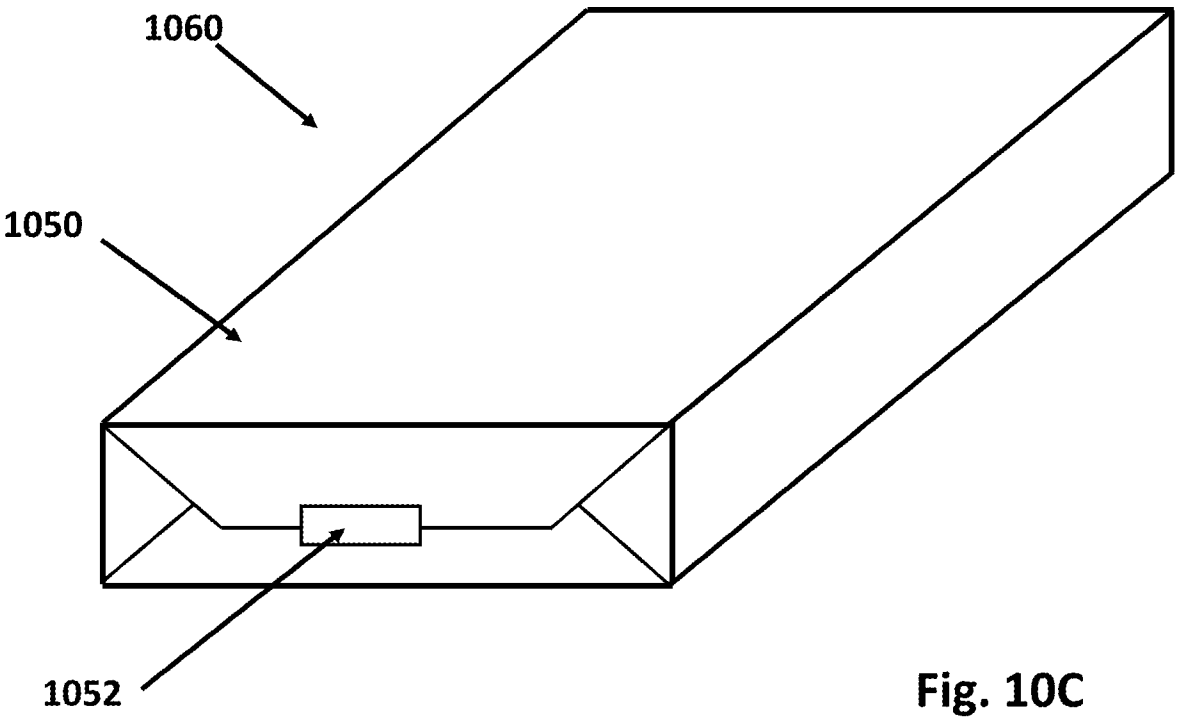
FIG. 10C is a left-front perspective view of a shingle package.

Referring to FIGS. 10B and 10C, the wrap 1050 may be disposed around the shingle assembly 1030 to form the shingle package 1060. The wrap 1050 may be plastic, construction paper, laminate, cloth, silicone, or any other suitable material. In one embodiment, the wrap is a waterproof material. In the illustrated embodiment, the wrap 1050 is secured around the shingle assembly 1030 by one or more fasteners 1052. The fasteners 1052 may be tape, staples, tacks, Velcro, pins, or any other suitable fastener. However, the wrap 1050 may disposed around the shingle assembly 1030 without the use of a fastener. For example, the wrap 1050 may be molded or heat sealed around the shingle assembly 1030.

In the illustrated embodiment, the wrap 1050 is disposed around the shingle assembly 1030 such that the wrap 1050 covers the top face 1032, the bottom face 1034, the front face 1036, the rear face 1038, the left side 1040, and the right side 1042 of the shingle assembly 1030. The free ends of the wrap 1050 may be secured together by fasteners 1052 on the left and rights sides 1040, 1042 of the shingle assembly 1030. As illustrated, the fasteners 1050 are pieces of tape. However, it will be appreciated that the free ends of the wrap may alternatively be secured on the top and bottom faces 1032, 1034 or the front and rear faces 1036, 1038 of the shingle assembly 1030.

Referring to FIGS. 11A through 12C, the shingle package 1060 may be cut into one or more shingle packets 1062. The shingle package 1060 may be cut by the cutter 900 with spaced apart blades 904 as described in FIG. 9A. However, it will be appreciated that the shingle package 1060 may be cut into shingle packets 1062 by any suitable cutter. The shingle package 1060 may be simultaneously cut into the shingle packets 1062 or each shingle packet 1062 may be individually cut from the shingle package 1060.

The shingle packets 1062 each have a shingle assembly portion 1064 with a top face 1066, a bottom face 1068, a front face 1070, a rear face 1072, a left side 1074, and a right side 1076 and a wrap portion 1080 at least partially disposed around the shingle assembly portion 1064. The shingle packets 1062 may each also have a length L extending between the left side 1074 and the right side 1076 of the shingle assembly portion 1064. The terms left side 1074 and right side 1076 merely describe the position of the respective sides of the shingle packet assembly portions 1064 in FIGS. 11A through 12C and may be switched. In the embodiments of FIGS. 11C and 12C, the shingle assembly portions 1064 are depicted as singular pieces rather than as stacked shingles for the sake of clarity. As will be described below, as the wrap 1050 is disposed around the shingle assembly 1030 to form the shingle package 1060 which is then cut into shingle packets 1062, the cut shingle packets 1062 each have at least one side 1074, 1076 which is not covered by the wrap portion 1080.

Figure 11A:
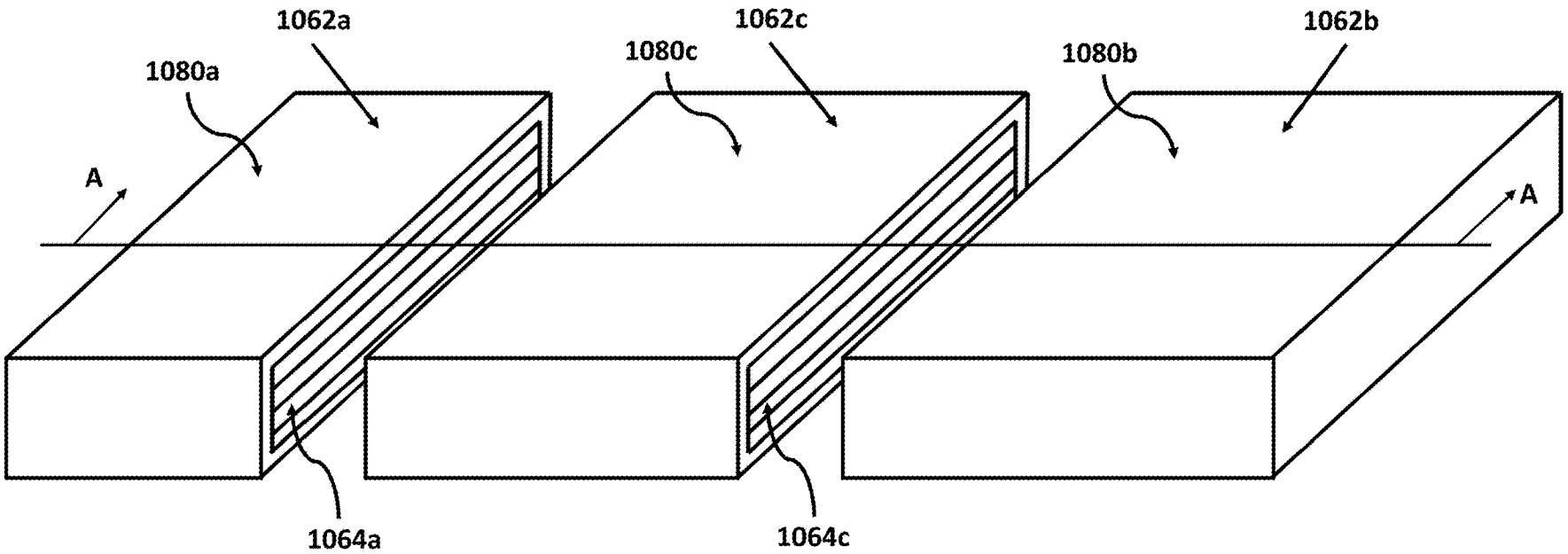
FIG. 11A illustrates one embodiment of the shingle package of FIG. 10C cut into shingle packets.
Figure 11B:
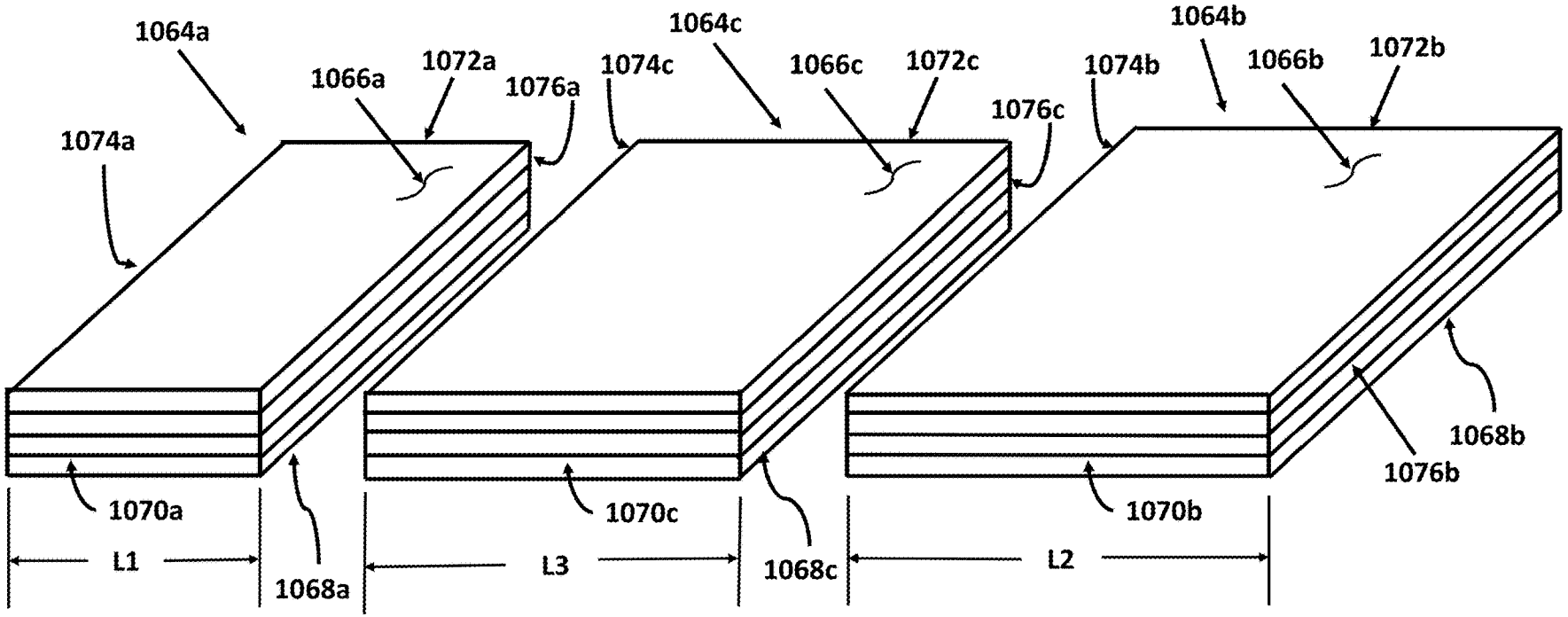
FIG. 11B illustrates the shingle packets of FIG. 11A without wrap portions.
Figure 11C:
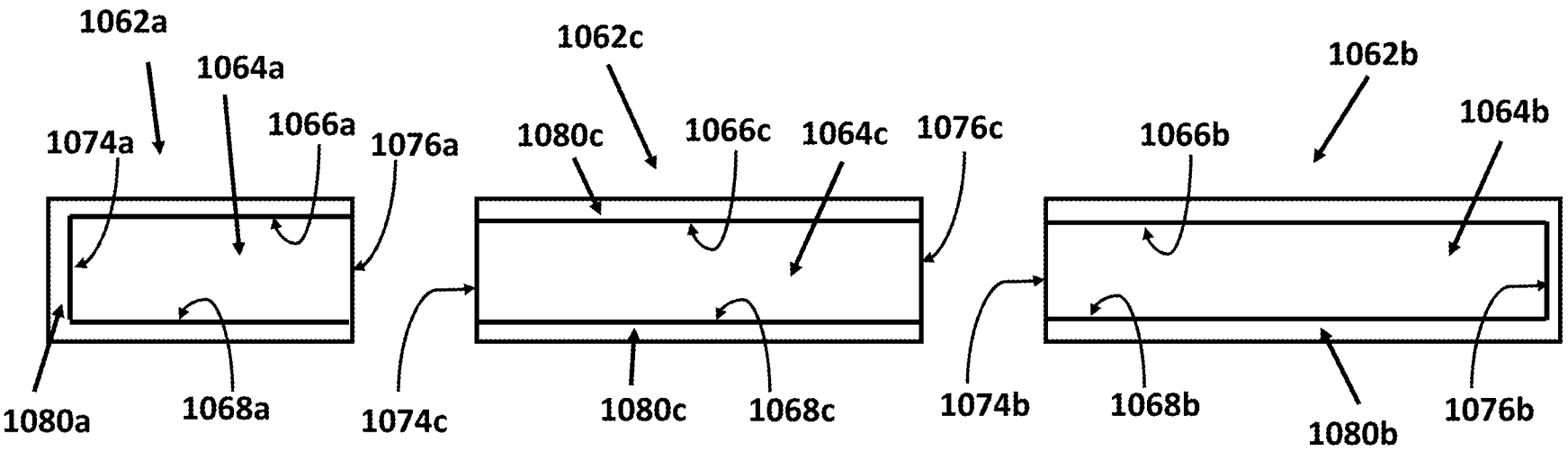
FIG. 11C illustrates a cross-sectional view of the shingle packets of FIG. 11A taken along line A-A.

In one embodiment, as shown in FIGS. 11A through 11C, the shingle package 1060 may be cut into a first shingle packet 1062*a* having a first shingle assembly portion 1064*a* and a first wrap portion 1080*a*, a second shingle packet 1062*b* having a second shingle assembly portion 1064*b* and a second wrap portion 1080*b*, and a third shingle packet 1062*c* having a third shingle assembly portion 1064*c* and a third wrap portion 1080*c*.

In the illustrated embodiment, the first wrap portion 1080*a* of the first shingle packet 1062*a* may be disposed around only the top face 1066*a*, the bottom face 1068*a*, the front face 1070*a*, the rear face 1072*a*, and the left side 1074*a* of the first shingle assembly portion 1064*a*. The second wrap portion 1080*b* of the second shingle packet 1062*b* may be disposed around only the top face 1066*b*, the bottom face 1068*b*, the front face 1070*b*, the rear face 1072*b*, and the right side 1076*b* of the second shingle assembly portion 1064*b*. The third wrap portion 1080*c* of the third shingle packet 1062*c* may be disposed around only the top face 1066*c*, the bottom face 1068*c*, the front face 1070*c*, and the rear face 1072*c* of the third shingle assembly portion 1064*c*.

The shingle package 1060 may be cut such that the first shingle packet 1062*a* has a first length L1, the second shingle packet 1062*b* has a second length L2, and the third shingle packet 1062*c* has a third length L3. The shingle packets 1062*a*, 1062*b*, 1062*c* may be cut such that the lengths L1, L2, L3 correspond to the lengths of the offset portions of the shingles with three offset portions described above, such as the shingles 300, 500 illustrated in FIGS. 3, 3A, 5, and 5A. In one example, the first length L1 of the first shingle packet 1062*a* may be one-sixth the length of the shingle package 1060, the second length L2 of the second shingle packet 1062*b* may be one-third the length of the shingle package 1060, and the third length L3 of the third shingle packet 1062*c* may be one-half the length of the shingle package 1060. In another example, the first length L1 of the first shingle packet 1062*a* may be one-sixth the length of the shingle package 1060, the second length L2 of the second shingle packet 1062*b* may be one-half the length of the shingle package 1060, and the third length L3 of the third shingle packet 1062*c* may be one-third the length of the shingle package 1060. However, it will be appreciated that the shingle packets 1062*a*, 1062*b*, 1062*c* may have any variation or combination of the lengths L1, L2, L3 such that the sum of the lengths of the shingle packets 1062*a*, 1062*b*, 1062 is equivalent to the length of the shingle package 1060.

Figure 12A:
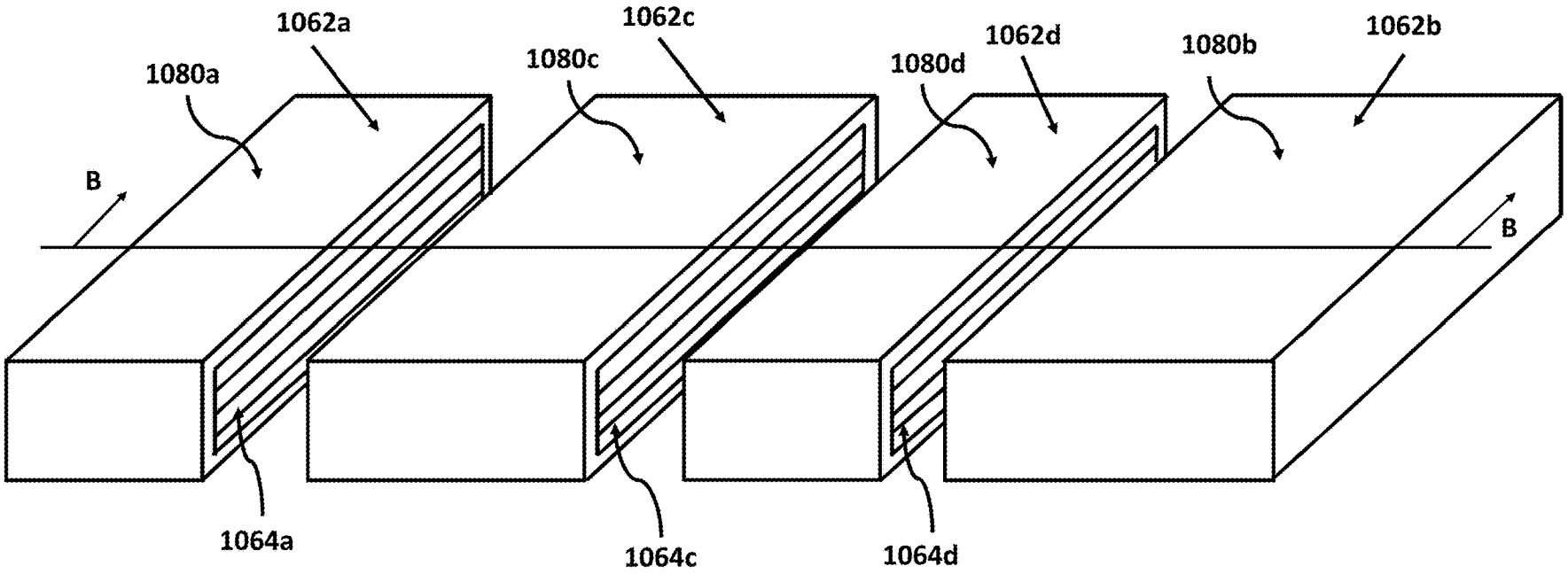
FIG. 12A illustrates a second embodiment of the shingle package of FIG. 10C cut into shingle packets.
Figure 12B:
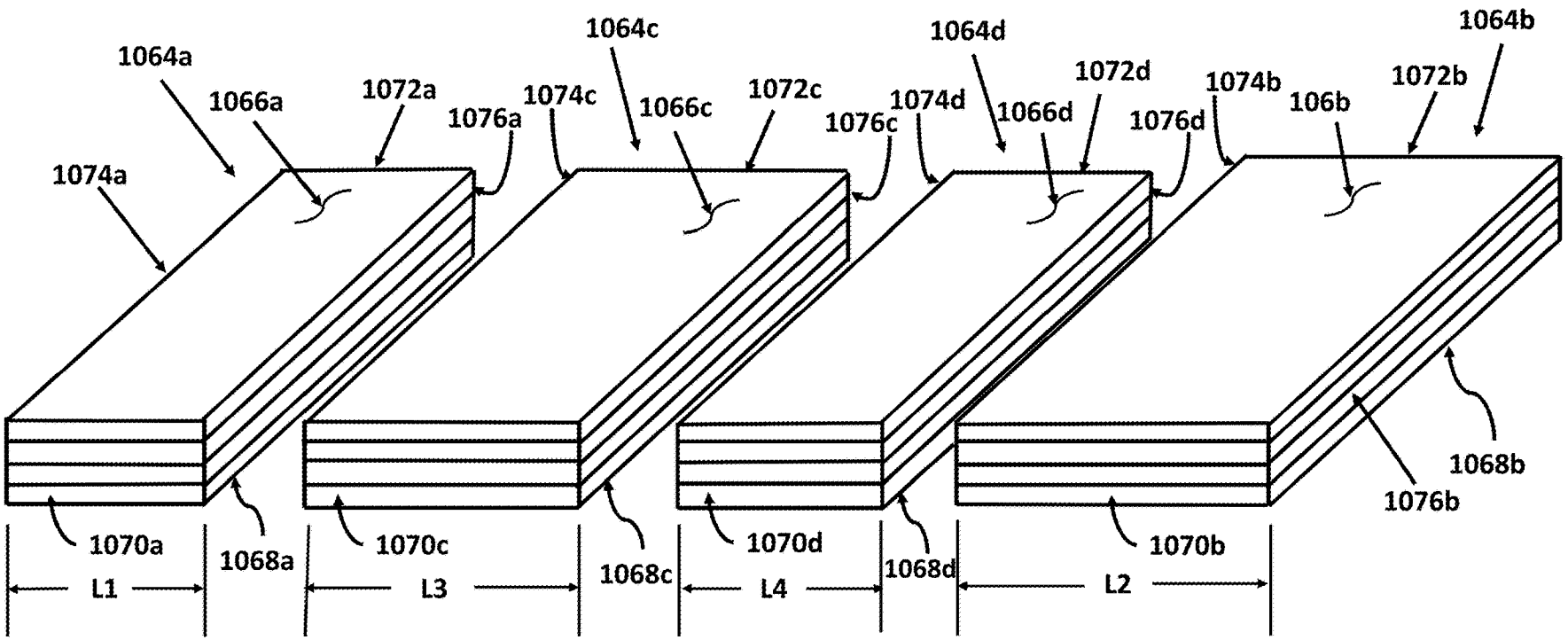
FIG. 12B illustrates the shingle packets of FIG. 12A without wrap portions.
Figure 12C:
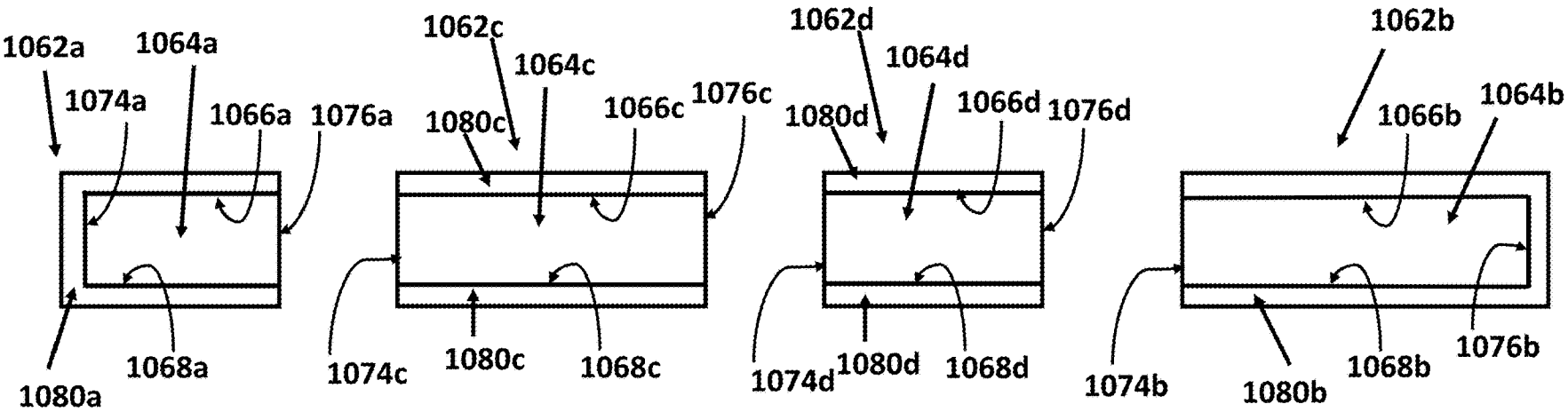
FIG. 12C illustrates a cross-sectional view of the shingle packets of FIG. 12A taken along line B-B.

In another embodiment, as shown in FIGS. 12A through 12C, the shingle package 1060 may be cut into a first shingle packet 1062*a* having a first shingle assembly portion 1064*a* and a first wrap portion 1080*a*, a second shingle packet 1062*b* having a second shingle assembly portion 1064*b* and a second wrap portion 1080*b*, and a third shingle packet 1062*c* having a third shingle assembly portion 1064*c* and a third wrap portion 1080*c*, and a fourth shingle packet 1062*d* having a fourth shingle assembly portion 1064*d* and a fourth wrap portion 1080*d*.

In the illustrated embodiment, the first wrap portion 1080*a* of the first shingle packet 1062*a* may be disposed around only the top face 1066*a*, the bottom face 1068*a*, the front face 1070*a*, the rear face 1072*a*, and the left side 1074*a* of the first shingle assembly portion 1064*a*. The second wrap portion 1080*b* of the second shingle packet 1062*b* may be disposed around only the top face 1066*b*, the bottom face 1068*b*, the front face 1070*b*, the rear face 1072*b*, and the right side 1076*b* of the second shingle assembly portion 1064*b*. The third wrap portion 1080*c* of the third shingle packet 1062*c* may be disposed around only the top face 1066*c*, the bottom face 1068*c*, the front face 1070*c*, and the rear face 1072*c* of the third shingle assembly portion 1064*c*. The fourth wrap portion 1080*d* of the fourth shingle packet 1062*d* may be disposed around only the top face 1066*d*, the bottom face 1068*d*, the front face 1070*d*, and the rear face 1072*d* of the fourth shingle packet assembly 1062*d*.

The shingle package 1060 may be cut such that the first shingle packet 1062*a* has a first length L1, the second shingle packet 1062*b* has a second length L2, the third shingle packet 1062*c* has a third length L3, and the fourth shingle packet 1062*d* has a fourth length L4. The shingle packets 1062*a*, 1062*b*, 1062*c*, 1062*d* may be cut such that the lengths L1, L2, L3, L4 correspond to the lengths of the offset portions of the shingles with four offset portions described above, such as the shingles 400, 700 illustrated in FIGS. 6, 6A, 7, and 7A.

In one example, the first length L1 of the first shingle packet 1602*a* may be one-sixth the length of the shingle package 1060, the second length L2 of the second shingle packet 1062*b* may be one-third the length of the shingle package 1060, the third length L3 of the third shingle packet 1062*c* may be one-third the length of the shingle package 1060, and the fourth length L4 of the fourth shingle packet 1062*d* may be one-sixth the length of the shingle package 1060. In another example, the first length L1 of the first shingle packet 1062*a* may be one-tenth the length of the shingle package 1060, the second length L2 of the second shingle packet 1062*b* may be two-fifths the length of the shingle package 1060, the third length L3 of the third shingle packet 1062*c* may be one-fifth the length of the shingle package 1060, and the fourth length L4 of the fourth shingle packet 1062*d* may be three-tenths the length of the shingle package 1062. However, it will be understood that the shingle packets 1062*a*, 1062*b*, 1062*c*, 1062*d* may have any variation or combination of lengths L1, L2, L3, L4 such that the sum of the lengths of the shingle packets 1062*a*, 1062*b*, 1062*c*, 1062*d* is equivalent to the length of the shingle package 1060.

While the shingle package 1060 has been described as being cut into three or four shingle packets 1602, the shingle package 1060 may be cut into any number of shingle packets 1062. For example, the shingle package 1060 may be cut into two or five or more shingle packets 1602.

Figure 13:
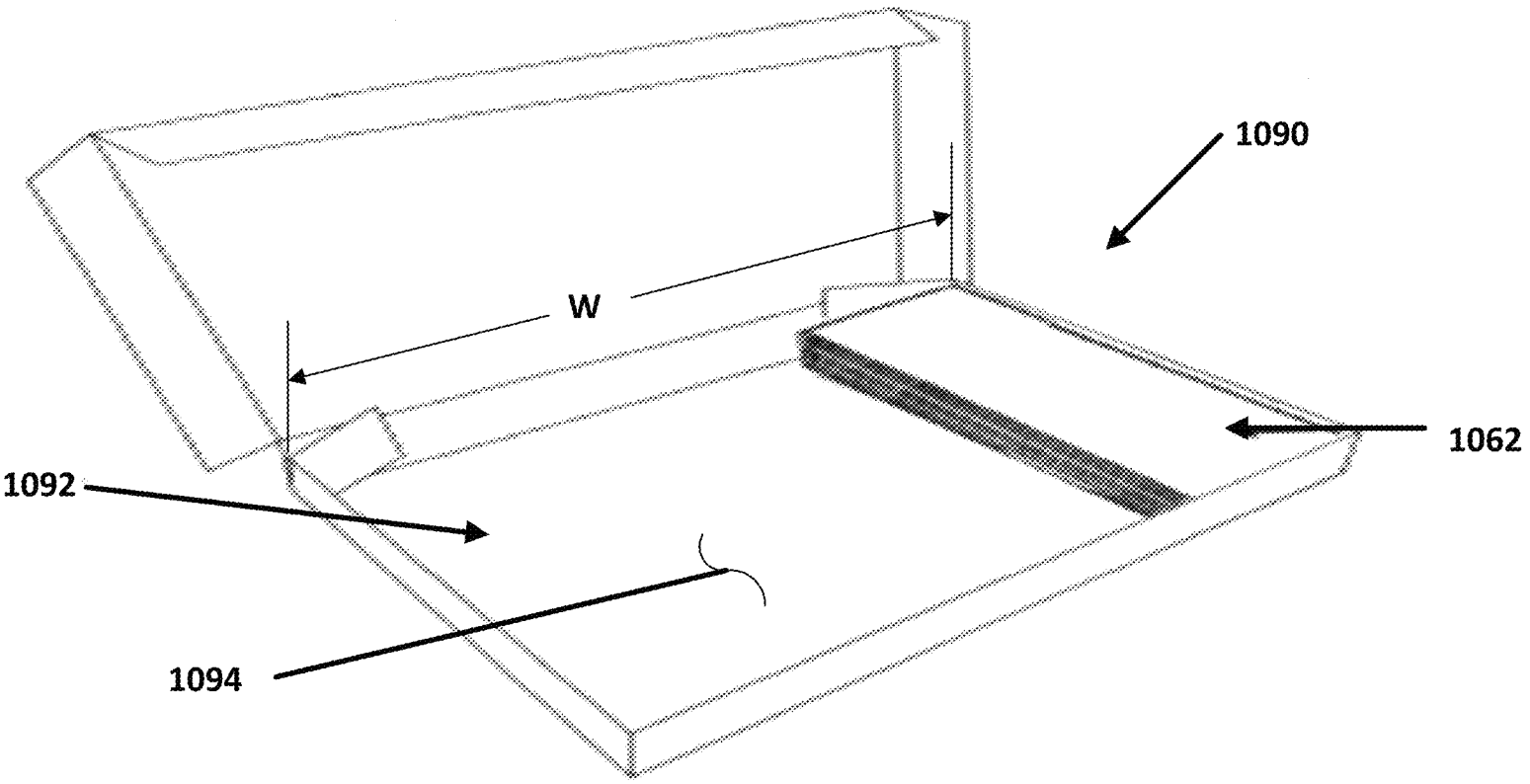
FIG. 13 illustrates packaging of shingle packets.

Referring to FIG. 13, one or more shingle packets 1062 may be disposed in an outer container 1090, such as a box, other container, or an additional outer wrap, which is the same or similar to the wrap illustrated by FIG. 10C. The outer container 1090 is shown and described as a box, but can be any type of container or wrap, unless the claims specifically recite a box, rather than a container. In one exemplary embodiment, all of the packets formed by cutting the package 1060 illustrated by FIG. 10C are placed in a container 1090 to form a kit of offset shingles.

The illustrated container 1090 may be a box that is similar to the boxes 820 illustrated in FIGS. 8E through 8G. However, it will be appreciated that the container 1090 may be any suitable storage container or wrap of any suitable size, construction, and material. The shingle packets 1062 may be disposed in an interior space 1092 of the box 1090. The shingle packets 1062 may be disposed along a width W of an upper surface 1094 of the box 1090 defining the bottom of the interior space 1092 of the box 1090. Multiple shingle packets 1062 may be disposed along the width W of the upper surface 1094 such that the shingle packets 1062 substantially fill the width W of the box 1090. In one embodiment, the width W of the container 1090 is substantially equivalent to the length of the shingle package 1060 such that all the shingle packets 1062 cut from a single shingle package 1060 substantially fill the width W of the container 1090.

In the illustrated embodiment, the shingle packets 1062 have substantially the same height as the interior space 1092 of the container 1090. In such an embodiment, all the shingle packets 1062 cut from a shingle package 1060 substantially fill the interior space 1092 of the container 1090. However, in other embodiments, the interior space 1092 of the container 1092 is sized such that multiple shingle packets 1062 may be disposed on the other shingle packets 1062 to substantially fill the interior space 1092 of the box 1090. Additionally, the width W of the container 1090 may be greater or less than the length of the shingle package 1060.

Once one or more shingle packets 1062 have been placed in the interior space 1092 of the container 1092, the container 1092 may then be closed and secured.

Figure 14:
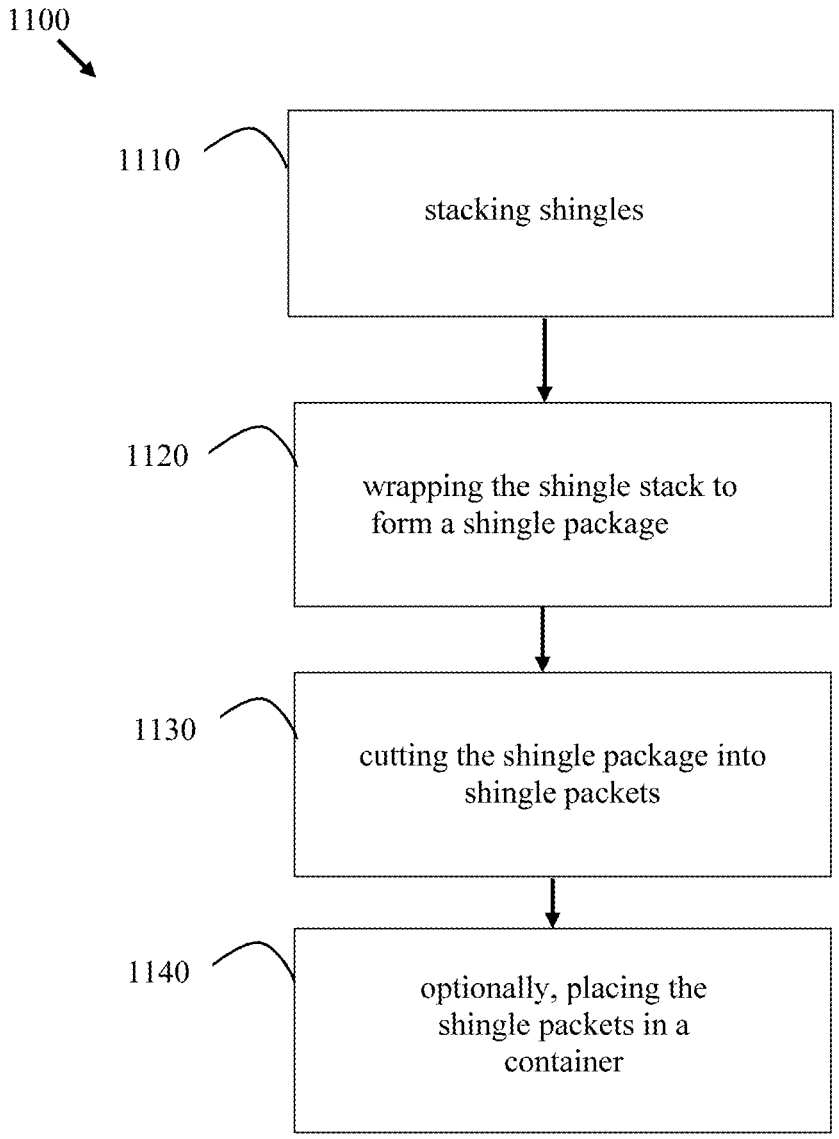
FIG. 14 illustrates an exemplary method of making and packaging shingles.

Referring to FIG. 14, a flow chart 1100 is illustrated depicting a method of packaging shingles 1000. In box 1110, two or more shingles 1000 may be assembled to form a shingle assembly 1030. As described above, the shingles 1000 may be arranged such that the sealant 1020 of a lower shingle 1000 is aligned with the release tape 1022 of a subsequent shingle 1000, or the shingles 1000 may be disposed in any other suitable arrangement.

In box 1120, a wrap 1050 may be disposed around the shingle assembly 1030 to form a shingle package 1060. The wrap 1050 may be disposed around the top face 1032, the bottom face 1034, the front face 1036, the rear face 1038, the left side 1040, and the right side 1042 of the shingle assembly 1030. In some embodiments, the wrap 1050 may be secured around the shingle assembly 1030 by one or more fasteners 1052.

In box 1130, the shingle package 1060 may be cut into two or more shingle packets 1062. The shingle packets 1062 may each have a shingle assembly portion 1064 and a wrap portion 1080. The wrap portion 1080 of two of the shingle packets 1062 may cover all but one side of the shingle assembly portion 1064 and the wrap portion 1080 or the remaining shingle packets 1062 may cover all but two sides of the shingle assembly portion 1064.

Optionally, as shown in box 1140, one or more shingle packets 1062 may be disposed in a box 1090. The shingle packets 1062 may be disposed along a length L of an upper surface 1094 defining the bottom of an interior space 1092 of the box 1090. Shingle packets 1062 may be disposed adjacent to and on other shingle packets 1062 to substantially fill the interior space 1092 of the box 1090. The box 1092 may then be closed and secured.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated. Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. An offset shingle kit comprising:

a first stack of cut shingle portions having a top face, a bottom face, a front face, a rear face, a left face, and a right face;

a second stack of cut shingle portions having a top face, a bottom face, a front face, a rear face, a left face, and a right face; and a third stack of cut shingle portions having a top face, a bottom face, a front face, a rear face, a left face, and a right face;

a first wrap around only the top face, the bottom face, the front face, the rear face, and the left face of the first stack;

a second wrap around only the top face, the bottom face, the front face, the rear face, and the right face of the second stack; and a third wrap around only the top face, the bottom face, the front face, and the rear face of a third stack.

2. The offset shingle kit of claim 1, further comprising a container enclosing the first, second, and third wraps.

3. The offset shingle kit of claim 2, wherein the container is an outer wrap that contacts the first wrap, the second wrap, and the third wrap.

4. The offset shingle kit of claim 2, wherein the container is a box.

5. The offset shingle kit of claim 1, wherein the first stack of cut shingle portions has a length that is less than a length of the second stack of cut shingle portions.

6. The offset shingle kit of claim 1, wherein:

the first stack of cut shingle portions has a length that is less than a length of the second stack of cut shingle portions; and the length of the first stack of cut shingle portions is less than a length of the third stack of cut shingle portions.

7. The offset shingle kit of claim 1, further comprising a fourth stack of cut shingle portions.

8. The offset shingle kit of claim 7, wherein the fourth stack of cut shingle portions has a fourth wrap portion disposed around only a top face, a bottom face, a front face, and a rear face of the fourth stack.

9. A method for packaging shingles, the method comprising:

stacking a plurality of shingles;

wrapping the stacked shingles to form a shingle package; and cutting the shingle package to form a first shingle packet of stacked shingle portions, a second shingle packet of stacked shingle portions, and a third shingle packet of stacked shingle portions;

wherein the first shingle packet has a wrap portion disposed around only a top face, a bottom face, a front face, a rear face, and a left face of the stacked shingle portions;

wherein the second shingle packet has a wrap portion disposed around only a top face, a bottom face, a front face, a rear face, and a right face of the stacked shingle portions; and wherein the third shingle packet has a wrap portion disposed around only a top face, a bottom face, a front face, and a rear face of the stacked shingle portions.

10. The method of claim 9, further comprising placing the first shingle packet, the second shingle packet, and the third shingle packet in a container.

11. The method of claim 10, wherein the container is an outer wrap.

12. The method of claim 10, wherein the container is a box.

13. The method of claim 9, wherein the first shingle packet has a length that is less than a length of the second shingle packet.

14. The method of claim 9, wherein the first shingle packet has a length that is less than a length of the third shingle packet.

15. The method of claim 9, wherein the second shingle packet has a length that is greater than a length of the third shingle packet.

16. The method of claim 9, further comprising cutting the shingle package to form a fourth shingle packet.

17. The method of claim 16, wherein the fourth shingle packet has a wrap portion disposed around only a top face, a bottom face, a front face, and a rear face of the stacked shingle portions.

18. A package of offset shingles comprising:

a first stack of cut shingle portions having a top face, a bottom face, a front face, a rear face, a left face, and a right face;

a second stack of cut shingle portions having a top face, a bottom face, a front face, a rear face, a left face, and a right face; and a third stack of cut shingle portions having a top face, a bottom face, a front face, a rear face, a left face, and a right face;

wherein the first, second, and third stacks of cut shingle portions all have different lengths;

a first wrap around only the top face, the bottom face, the front face, the rear face, and the left face of the first stack;

a second wrap around only the top face, the bottom face, the front face, the rear face, and the right face of the second stack;

a third wrap around only the top face, the bottom face, the front face, and the rear face of a third stack; and a container surrounding the first, second, and third wraps.

19. The package of offset shingles of claim 18, wherein the container is an outer wrap.

20. The package of offset shingles of claim 18, wherein the container is a box.

* * * * *